US009539722B2

(12) United States Patent
Martinez et al.

(10) Patent No.: US 9,539,722 B2
(45) Date of Patent: Jan. 10, 2017

(54) TOOL STORAGE DEVICES

(71) Applicant: Milwaukee Electric Tool Corporation, Brookfield, WI (US)

(72) Inventors: Mark R. Martinez, Atwater, CA (US); Joel Allen, Winton, CA (US); Brandon Miller, Milwaukee, WI (US); Whitney M. Moks, Franklin, WI (US); Christopher S. Hoppe, Milwaukee, WI (US); Steven W. Hyma, Milwaukee, WI (US); Michael S. Steele, Waukesha, WI (US); Steven G. Melnyk, Cedarburg, WI (US); Wade F. Burch, Wauwatosa, WI (US); Matthew W. Naiva, Wauwatosa, WI (US); Eric Mackey, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 21 days.

(21) Appl. No.: 14/134,468

(22) Filed: Dec. 19, 2013

(65) Prior Publication Data

US 2014/0166516 A1 Jun. 19, 2014

Related U.S. Application Data

(60) Provisional application No. 61/867,438, filed on Aug. 19, 2013, provisional application No. 61/840,265, (Continued)

(51) Int. Cl.
*B25H 3/02* (2006.01)
*B25H 3/00* (2006.01)

(52) U.S. Cl.
CPC ..... *B25H 3/02* (2013.01); *B25H 3/022* (2013.01); *B25H 3/023* (2013.01); *B25H 3/026* (2013.01); *Y10S 312/902* (2013.01)

(58) Field of Classification Search
USPC .. 206/372, 373, 557, 628, 477, 483; 15/323, 344, 347; 312/108, 902, 237; D3/281, 294, 905
See application file for complete search history.

(56) References Cited

U.S. PATENT DOCUMENTS 2,125,856 A 8/1938 De Witt
2,145,143 A 1/1939 Trecartin
(Continued)

FOREIGN PATENT DOCUMENTS

FR 2657915 8/1991

OTHER PUBLICATIONS

SKB cases, I Series Indestructible Catalog (2010) 16 pages.
(Continued)

*Primary Examiner* — J. Gregory Pickett
*Assistant Examiner* — Gideon Weinerth
(74) *Attorney, Agent, or Firm* — Michael Best & Friedrich LLP

(57) ABSTRACT

A tool storage device and a tool box. The device may include flexible walls cooperating to define a storage area, and a rigid frame supported in the storage area and including a central portion extending in a direction from a bottom wall toward a top wall, one base portion extending from one side of the central portion, along the bottom wall and toward one side wall, and another base portion extending from an opposite side of the central portion, along the bottom wall and toward an opposite side wall. The tool box may include a body defining a storage compartment; a lid defining a groove in its outer surface to support an elongated work piece; and a handle engageable with a work piece supported in the groove. The lid may be attachable to the top of the body in a closed position and to the bottom in a stowed position.

25 Claims, 28 Drawing Sheets

Related U.S. Application Data filed on Jun. 27, 2013, provisional application No. 61/839,783, filed on Jun. 26, 2013, provisional application No. 61/766,493, filed on Feb. 19, 2013, provisional application No. 61/739,530, filed on Dec. 19, 2012, provisional application No. 61/739,473, filed on Dec. 19, 2012, provisional application No. 61/739,459, filed on Dec. 19, 2012.

(56) References Cited

U.S. PATENT DOCUMENTS 2,799,306 A * 7/1957 Martin ..... B25H 1/04 144/285
2,883,184 A * 4/1959 Brewington ..... B23K 3/087 269/16
3,177,023 A 4/1965 Nuckols
3,259,411 A 7/1966 Griffiths
3,394,955 A 7/1968 Martin
3,817,419 A 6/1974 Moller et al.
3,851,756 A * 12/1974 Brown ..... B25H 1/04 108/131
3,924,844 A 12/1975 Bachtel, Jr.
4,105,112 A 8/1978 Graf
D259,154 S 5/1981 White, Jr. et al.
4,278,187 A 7/1981 Luedtke
4,353,182 A * 10/1982 Junkas ..... A01K 97/06 206/315.11
D272,203 S 1/1984 Di Bartolo
4,890,414 A 1/1990 Bridenthal et al.
D309,981 S 8/1990 French et al.
5,042,193 A 8/1991 Steiner
D326,815 S * 6/1992 Meisner ..... D7/605
5,165,148 A 11/1992 Fleischer et al.
D333,215 S 2/1993 Brown
D333,487 S 2/1993 Papp
5,295,742 A 3/1994 Knutson
D347,731 S 6/1994 Hayakawa et al.
5,379,887 A 1/1995 Conley, Jr.
D355,849 S * 2/1995 Trower ..... D3/282
5,386,907 A 2/1995 Kahl et al.
5,429,287 A 7/1995 Frano
5,470,000 A 11/1995 Muñoz
D368,159 S 3/1996 Calmeise et al.
5,501,379 A 3/1996 Muñoz
5,518,139 A 5/1996 Trower et al.
D370,619 S 6/1996 Hall et al.
D374,772 S * 10/1996 Hotaling ..... D3/273
5,562,208 A 10/1996 Hasler et al.
D375,834 S 11/1996 Meisner et al.
5,580,137 A 12/1996 Doan et al.
D377,118 S 1/1997 Carbone et al.
5,595,228 A 1/1997 Meisner et al.
D378,247 S 3/1997 Meisner et al.
5,620,212 A 4/1997 Bourne et al.
5,660,276 A 8/1997 Winnard
5,672,145 A 9/1997 Pollington et al.
D385,110 S * 10/1997 Yemini ..... D3/276
D386,903 S 12/1997 Curry et al.
D390,358 S 2/1998 Calmeise
5,732,987 A 3/1998 Wright et al.
5,755,311 A 5/1998 Younessian et al.
5,762,411 A * 6/1998 Yemini ..... B25H 3/003 206/372
D402,106 S 12/1998 Buckingham et al.
D405,956 S 2/1999 Meisner et al.
5,915,553 A 6/1999 Brown et al.
5,915,554 A 6/1999 Hung
5,924,533 A 7/1999 Cnockaert et al.
D414,038 S * 9/1999 van Rhienen ..... D3/273
6,006,906 A 12/1999 Winnard
D418,977 S 1/2000 Streich
6,015,064 A 1/2000 Liu
6,038,747 A 3/2000 Hamilton et al.
6,073,766 A 6/2000 Winnard
6,081,695 A 6/2000 Wallace et al.
6,082,538 A 7/2000 Snider et al.
6,167,680 B1 1/2001 Horn
6,176,559 B1 * 1/2001 Tiramani ..... B25H 3/023 280/47.19
D437,684 S 2/2001 Streich et al.
6,203,075 B1 3/2001 Wells, Jr. et al.
6,206,063 B1 * 3/2001 Lin ..... B25H 1/12 144/285
6,213,296 B1 4/2001 Streich et al.
6,230,887 B1 5/2001 Snider
6,244,485 B1 6/2001 Holland et al.
6,244,486 B1 6/2001 Holland et al.
D447,340 S 9/2001 Snider
D447,630 S 9/2001 Snider
D448,162 S 9/2001 Snider
D449,442 S 10/2001 Snider
D449,738 S 10/2001 Snider et al.
D451,275 S 12/2001 Snider et al.
D452,071 S 12/2001 Snider
D453,624 S * 2/2002 Itzkovitch ..... D3/276
6,343,708 B1 2/2002 Riso
6,343,815 B1 2/2002 Poe
6,347,847 B1 * 2/2002 Tiramani ..... B25H 3/00 190/18 A
D455,263 S 4/2002 Schoen et al.
6,371,320 B2 4/2002 Sagol
D459,073 S * 6/2002 Lee ..... D3/276
6,405,864 B1 6/2002 Streich et al.
6,415,924 B1 7/2002 Lee
D462,168 S * 9/2002 Klemmensen ..... D3/276
D465,923 S 11/2002 Pangerc et al.
6,478,463 B2 11/2002 Snider
D467,070 S 12/2002 Snider et al.
6,502,882 B2 1/2003 Snider et al.
D470,659 S 2/2003 Story et al.
D471,360 S 3/2003 Huang
6,527,309 B1 3/2003 Gaydos et al.
6,533,138 B2 3/2003 Chwen-Ru
D472,774 S 4/2003 Pelstring et al.
6,561,402 B2 5/2003 Holland et al.
6,614,337 B1 9/2003 Winnard
6,622,856 B2 9/2003 Gallo et al.
D480,867 S 10/2003 Snider et al.
6,675,965 B2 1/2004 Holland et al.
6,675,967 B2 1/2004 Huang
6,695,142 B2 2/2004 Chen et al.
6,698,609 B2 3/2004 Pangerc et al.
6,722,524 B1 4/2004 Huang et al.
6,755,302 B1 6/2004 Streich et al.
6,755,448 B2 6/2004 Jackson et al.
6,761,366 B1 * 7/2004 Klemmensen ..... B25H 3/023 16/113.1
6,789,670 B2 9/2004 Cooper et al.
6,860,059 B1 3/2005 Hoover
D505,548 S 5/2005 Yang
6,915,902 B2 7/2005 Brouard
D509,656 S 9/2005 Pangerc et al.
6,955,381 B2 10/2005 Parker et al.
6,978,890 B2 12/2005 Pangerc et al.
D516,310 S 3/2006 Brunson et al.
D516,808 S 3/2006 Brunson et al.
D516,812 S 3/2006 Pangerc et al.
7,008,031 B2 3/2006 Doerflinger et al.
7,021,637 B2 4/2006 Snider et al.
D520,746 S 5/2006 Meyer et al.
7,048,133 B2 5/2006 Pangerc et al.
7,108,131 B2 9/2006 Dreher et al.
7,121,407 B2 10/2006 Hurt et al.
7,158,376 B2 1/2007 Richardson et al.
7,225,923 B2 6/2007 Hallee et al.
7,228,983 B2 6/2007 Pangerc et al.
7,237,673 B2 7/2007 Wikle et al.
7,237,688 B2 7/2007 Pangerc et al.
7,246,704 B2 7/2007 Brunson et al.
7,316,309 B2 1/2008 Streich et al.
7,322,470 B2 1/2008 Brunson
7,326,428 B2 2/2008 Weir
7,334,680 B2 2/2008 Cunningham et al.

(56) References Cited

U.S. PATENT DOCUMENTS

D563,669 S 3/2008 Bosak et al.
7,357,250 B2 4/2008 Hagemann et al.
7,357,268 B2 4/2008 Yang
7,367,451 B2 5/2008 Pendergraph et al.
7,370,891 B1 5/2008 Schmitt et al.
D572,479 S 7/2008 Buck et al.
D572,480 S 7/2008 Buck et al.
7,401,698 B2 7/2008 Dost et al.
7,401,700 B2 7/2008 Dost et al.
7,418,846 B2 9/2008 James et al.
D588,811 S 3/2009 Wenchel et al.
D589,703 S 4/2009 Wenchel et al.
7,540,364 B2 6/2009 Sanderson
7,552,560 B2 6/2009 Hoover
7,552,950 B2 6/2009 Scheffy et al.
D599,112 S 9/2009 Wenchel et al.
D600,015 S 9/2009 Wenchel et al.
D600,912 S 9/2009 Brunner
D601,797 S 10/2009 Wenchel et al.
7,600,640 B2 10/2009 Hallee et al.
D605,403 S 12/2009 Santamarina et al.
D608,094 S 1/2010 Concari et al.
D609,911 S * 2/2010 Twig ..... D3/279
D609,913 S * 2/2010 Landau ..... D3/291
7,661,530 B1 2/2010 Hewitt
D616,200 S 5/2010 Riedel et al.
D618,911 S 7/2010 Brunner
D624,317 S 9/2010 Wenchel et al.
D627,968 S 11/2010 Brunner
7,837,053 B2 11/2010 Arnett et al.
D629,607 S * 12/2010 Sabbag ..... D3/282
7,845,653 B2 12/2010 Katz
7,854,321 B2 12/2010 Twig et al.
D630,435 S 1/2011 Brunner
D630,851 S * 1/2011 Landau ..... D3/279
7,874,328 B2 1/2011 Dancyger
7,883,096 B2 2/2011 Katz et al.
D635,769 S 4/2011 Sosnovsky
D636,996 S 5/2011 Kokawa et al.
D637,812 S 5/2011 Horiyama et al.
7,938,412 B2 5/2011 Katz
D639,554 S * 6/2011 Sosnovsky ..... D3/276
D641,552 S 7/2011 Sosnovsky
7,984,820 B2 7/2011 Dancyger
D647,301 S 10/2011 Sosnovsky
D648,532 S 11/2011 Sosnovsky
D648,533 S 11/2011 Sosnovsky
D649,350 S 11/2011 Shitrit
8,056,943 B2 11/2011 Scheffy et al.
8,061,536 B2 11/2011 Lin et al.
D649,783 S 12/2011 Brunner
8,132,819 B2 * 3/2012 Landau ..... B25H 3/028 280/47.131
8,152,037 B2 4/2012 Sabbag
D661,858 S * 6/2012 Lifshitz ..... D34/25
D661,903 S 6/2012 Kokawa et al.
8,191,910 B2 6/2012 Landau et al.
D664,354 S * 7/2012 Crevling, Jr. ..... D3/274
8,210,387 B2 7/2012 Twig et al.
8,267,245 B2 9/2012 Kotula et al.
8,267,247 B1 9/2012 Horiyama
8,272,628 B2 9/2012 Winnard
D668,867 S 10/2012 Yamamot
D668,868 S 10/2012 Lehovetzki
D668,869 S 10/2012 Yamamoto et al.
D670,500 S 11/2012 Sosnovsky
D672,555 S * 12/2012 Shitrit ..... D3/281
8,327,576 B2 12/2012 Sellers
8,328,247 B2 12/2012 Tonelli
D673,774 S 1/2013 Neuhaus et al.
8,376,177 B2 2/2013 Castner et al.
8,434,617 B1 5/2013 Wang
8,469,195 B2 6/2013 Gosselink et al.
8,505,729 B2 8/2013 Sosnovsky et al.
8,657,307 B2 * 2/2014 Lifshitz ..... B25H 3/028 280/47.17
D701,696 S * 4/2014 Shitrit ..... D3/279
D744,750 S * 12/2015 Sabbag ..... D3/281
D750,890 S * 3/2016 Quehl ..... D3/281
2002/0014507 A1 2/2002 Snider et al.
2002/0043534 A1 4/2002 Uke
2002/0074332 A1 6/2002 Sagol
2002/0125160 A1 * 9/2002 Itzkovitch ..... B25H 3/02 206/373
2003/0075468 A1 4/2003 Story et al.
2004/0112777 A1 6/2004 Huang
2005/0109650 A1 5/2005 Huang
2006/0017293 A1 1/2006 Tonelli
2006/0124505 A1 * 6/2006 Hanson ..... B25H 3/00 206/702
2006/0144732 A1 7/2006 Kaplan et al.
2006/0201834 A1 9/2006 Lutz
2007/0137960 A1 6/2007 Redzisz
2007/0194543 A1 * 8/2007 Duvigneau ..... A45C 7/0045 280/47.26
2007/0241113 A1 10/2007 Williams
2008/0017537 A1 1/2008 Inskeep et al.
2008/0035508 A1 2/2008 Streich et al.
2008/0035510 A1 2/2008 Brunson
2008/0067206 A1 3/2008 Kuhn
2008/0152944 A1 6/2008 Bonini et al.
2008/0164842 A1 7/2008 Bergner
2008/0169739 A1 7/2008 Goldenberg
2008/0230416 A1 9/2008 Brouard
2009/0080809 A1 3/2009 Pham et al.
2009/0211932 A1 8/2009 Schmitt et al.
2009/0236810 A1 * 9/2009 Anderson ..... B25H 3/00 280/47.34
2009/0250365 A1 10/2009 Goto et al.
2010/0012538 A1 1/2010 Brunner
2010/0012655 A1 1/2010 Dathy
2010/0033325 A1 2/2010 Vilkomirski et al.
2010/0224527 A1 9/2010 Huang
2010/0258465 A1 10/2010 Gomas
2011/0084075 A1 4/2011 Arnett et al.
2011/0094910 A1 4/2011 Fleury et al.
2011/0132046 A1 6/2011 Tonelli
2011/0174648 A1 7/2011 Huang et al.
2011/0268374 A1 11/2011 Hotta et al.
2012/0018330 A1 1/2012 Kato et al.
2012/0152944 A1 6/2012 Vilkomirski et al.
2012/0206907 A1 8/2012 Seidel
2012/0257379 A1 10/2012 Herr et al.
2012/0267374 A1 10/2012 Kotula et al.
2012/0292213 A1 11/2012 Brunner
2012/0312708 A1 12/2012 Roehm et al.
2012/0317933 A1 12/2012 Crull
2012/0318792 A1 12/2012 Larson et al.
2012/0326406 A1 12/2012 Lifshitz et al.
2012/0326669 A1 12/2012 Horiyama et al.
2013/0007979 A1 * 1/2013 Wolfe ..... A47L 9/0018 15/323
2013/0186795 A1 7/2013 Borrelli
2014/0102928 A1 * 4/2014 Sabbag ..... B25H 3/027 206/372

OTHER PUBLICATIONS

Barska, "Barska Loaded Gear HD-400 Watertight Dry Box" website available as early as Mar. 13, 2013.
JR Shooting Sports, "Genuine Browning Shooting Accessories Utility Cases" website available as early as Aug. 20, 2003.
United States Patent Office Action for U.S. Appl. No. 14/802,539 dated Aug. 15, 2016 (18 pages).

* cited by examiner

TOOL STORAGE DEVICES

CROSS-REFERENCE TO RELATED APPLICATIONS

This application claims priority to U.S. Provisional Patent Application No. 61/739,459, filed Dec. 19, 2012, to U.S. Provisional Patent Application No. 61/739,473, filed Dec. 19, 2012, to U.S. Provisional Patent Application No. 61/739,530, filed Dec. 19, 2012, to U.S. Provisional Patent Application No. 61/766,493, filed Feb. 19, 2013, to U.S. Provisional Patent Application No. 61/839,783, filed Jun. 26, 2013, to U.S. Provisional Patent Application No. 61/840,265, filed Jun. 27, 2013, and to U.S. Provisional Patent Application No. 61/867,438, filed Aug. 19, 2013, the entire contents of all of which are hereby incorporated by reference.

FIELD OF THE INVENTION

The present invention relates to tool storage devices, including tool boxes, tool bags, tool belts, etc.

SUMMARY OF THE INVENTION

Tool storage devices, such as tool boxes, belts, pouches, totes, and bags, are most commonly used to conveniently store and organize tools and accessories. Tools and accessories are often transported between worksites, so portability is an important design consideration for tool storage devices. Durability is also an important factor because tool storage devices may be used in various terrains and in various weather conditions at worksites. Finally, accessibility is another important design consideration because tools and/or accessories that are difficult to access or remove from the tool storage device at the worksite can cause project delays, increased cost, and aggravation.

In one independent embodiment, a tool storage device may generally include flexible walls cooperating to define a storage area to receive tools, the walls including a bottom wall, a top wall and a plurality of side walls extending between the bottom wall and the top wall; a rigid frame supported in the storage area and including a central portion extending in a direction from the bottom wall toward the top wall, a first base portion extending from one side of the central portion, along the bottom wall and toward one side wall, and a second base portion extending from an opposite side of the central portion, along the bottom wall and toward an opposite side wall; and a handle directly connected to the central portion and engageable by a user In another independent embodiment, a tool box may generally include a body including a bottom wall and side walls extending from the bottom and cooperating to define a storage compartment, the bottom wall having an outer periphery, the side walls having a top edge; and a lid movable relative to the body, the lid having a rim engageable with the top edge of the side walls in a closed position to close the storage area, the lid being movable from the closed position toward an open position to permit access to the storage compartment, the lid having an attachment portion located inwardly of the rim and engageable with the outer periphery of the bottom wall to retain the lid on the bottom wall in a stowed position.

In yet another independent embodiment, a tool box may generally include a body defining a storage compartment; a lid movable relative to the body between an open position to permit access to the storage compartment and a closed position to close the storage compartment, the lid having an outer surface, opposite end walls and a length defined between the opposite end walls, a groove being defined in the outer surface, the groove extending the length of the lid and opening through the end walls, the groove being configured to support an elongated work piece; and a handle pivotally coupled to the lid and extending along an axis parallel to the length of the lid, the handle being pivotable to engage a work piece supported in the groove.

In a further independent embodiment, a tool box may generally include a body defining a storage compartment; a lid movable relative to the body between an open position to permit access to the storage compartment and a closed position to close the storage compartment, the lid having an inner surface facing toward the storage compartment in the closed position; a power tool battery charger; and a mounting arrangement between the lid and the battery charger to mount the battery charger to the inner surface of the lid in an operational position.

In some constructions, the mounting arrangement includes a projection on one of the inner surface of the lid and the battery charger and a recess defined on the other of the inner surface of the lid and the battery charger, the projection being engageable in the recess to mount the charger to the lid. In some constructions, the projection is provided on the inner surface of the lid, and the recess is defined on the charger. In such constructions, the inner surface of the lid may define a boss, and a separate projection (e.g., a fastener) is supported by the boss. In some constructions, the mounting arrangement includes at least two projections and complementary recesses.

In another independent embodiment, a tool storage system may generally include a first tool box have a bottom surface and a top surface, a second tool box having a bottom surface and a top surface and a connecting arrangement provided between the first tool box and the second tool box and operable to connect one tool box on top of the other tool box, the connecting arrangement including a plurality of projections on one of the bottom surface and the top surface of each tool box and a plurality of complementary recesses on the other of the bottom surface and the top surface of each tool box, the projections being engageable in the recesses to connect the tool boxes.

In some constructions, the first tool box has a first length, and the second tool box has a different second length, the projections and the recesses being arranged on the first tool box and the second tool box to connect the tool boxes in at least two spaced apart locations along the length of the tool boxes. In some constructions, a third tool box has a third length different than the first length and the second length, and the projections and recesses are arranged on the tool boxes to selectively connect the second tool box to the first tool box and the third tool box to the first tool box in at least two spaced apart locations along the length of the tool boxes. In such constructions, the third tool box is also connectable to the second tool box in at least two spaced apart locations along the length of the tool boxes.

In yet another independent embodiment, a tool box may generally include a body defining a storage compartment; a lid movable relative to the body between an open position to permit access to the storage compartment and a closed position to close the storage compartment, the lid having opposite end walls and a lid length defined between the opposite end walls; and a handle extending along an axis parallel to the length of the lid and having a handle length, the handle having a grip portion engageable by a user to carry the tool box, the grip portion having a grip length, at least one of the ratio of the handle length to the lid length being between about 0.55 and about 0.35 and the ratio of the grip length to the lid length being between about 0.50 and about 0.30.

In a further independent embodiment, a tool storage device may generally include a rigid container having a generally square cross-section, the container including a bottom wall and side walls extending from the bottom wall and cooperating to define a storage area, each of two opposite side walls defining a groove; and a divider including opposite side edges, each receivable in an associated groove to connect the divider to the container, the divider, when connected dividing the storage area into a first area and a second area; the divider including a handle to facilitate removal of the divider from the container.

In another independent embodiment, a tool storage device may generally include a container defining a storage area and including at least one wall defining a plurality of slots; and an insert including a rigid body, organizers including at least one pocket and loop attached to the body, and tongues insertable into complementary slots in the wall to connect the insert to the container.

In yet another independent embodiment, a tool box may generally include a body defining a storage compartment; a lid movable relative to the body between an open position to permit access to the storage compartment and a closed position to close the storage compartment; and at least one latch assembly operable to releasably retain the lid in the closed position. The latch assembly may include a latch body pivotally coupled to the lid, and a latch member pivotally coupled to the latch body and including a latch portion, with the lid in a closed position, the latch body being pivotable relative to the lid and the latch member being pivotable relative to the latch body between a latch position, in which the latch portion is engageable with the body to releasably retain the lid in the closed position, and a release position, in which the latch portion is disengaged from the body.

Other independent features and independent aspects of the invention will become apparent by consideration of the following detailed description, claims and accompanying drawings.

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting.

DETAILED DESCRIPTION

FIGS. 1-6 illustrate a tool bag 1010 and related components. The illustrated tool bag 1010 (FIGS. 1 and 5-6) is a portable tool bag, transportable between worksites (e.g., construction sites, garages, etc.) and for storing tools and accessories in an organized manner.

The tool bag 1010 includes a bottom panel 1014, a front panel 1018, a back panel 1022, end panels 1026, 1030, and a top panel 1034. The panels 1014-1034 are formed of tough, durable, tear-resistant, and/or water-resistant material, such as polyester, nylon, or other suitable material, and each panel 1014-1034 is adaptable with or without a logo, design, adornment, and/or ornamentation. Adjacent panels 1014-1034 are coupled by stitching along the common edges. Joining the panels 1014-1034 together creates a storage space 1046 (FIG. 1) configured to store tools and accessories.

The tool bag 1010 includes reinforced corners 1038 to provide additional strength and stability. The reinforced corners 1038 may be formed of the same material as the adjoining panels 1014-1034 or another suitable material. The edges of each panel 1014-1034 may also be reinforced for additional strength and stability. The tool bag 1010 is also provided, on one or more panels 1014-1034, with a double stitch design 1042 (FIG. 1) or other stitch design to provide increased durability.

Figure 1:
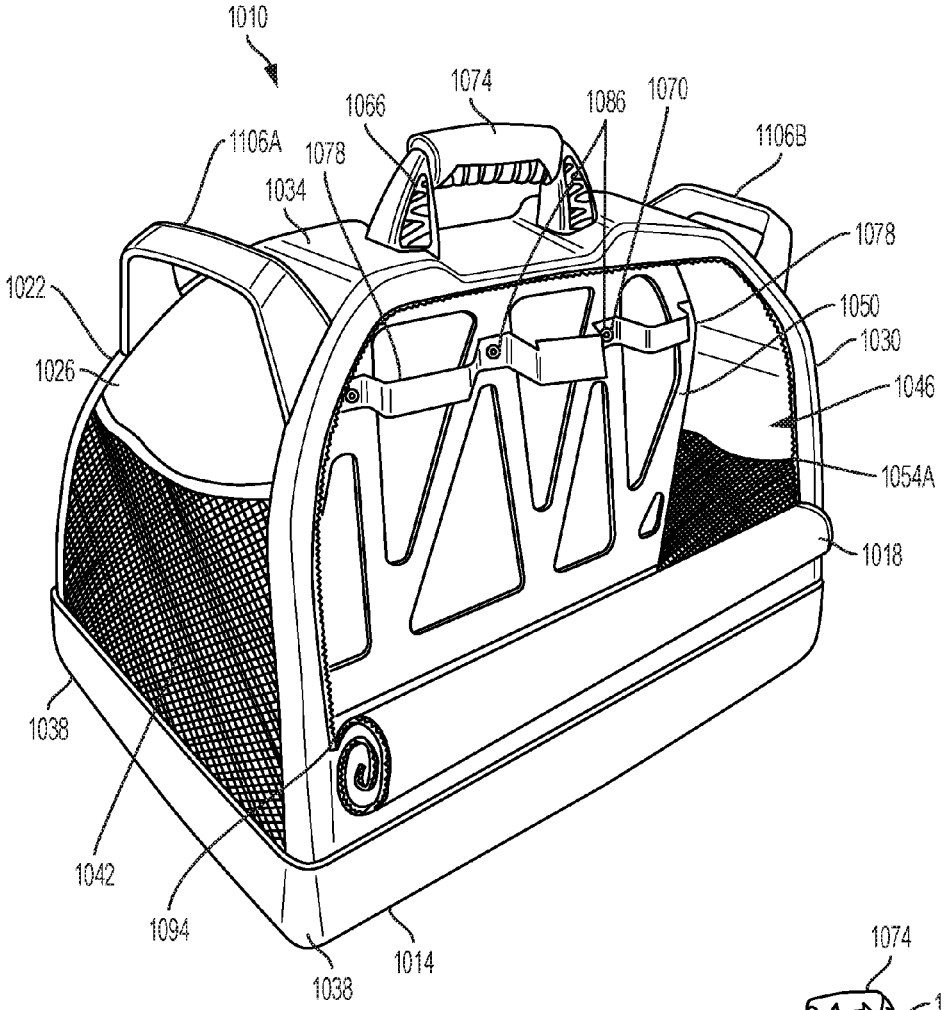
FIG. 1 is a front perspective view of a tool bag according to one independent embodiment and illustrates an interior storage space of the tool bag.
Figure 2:
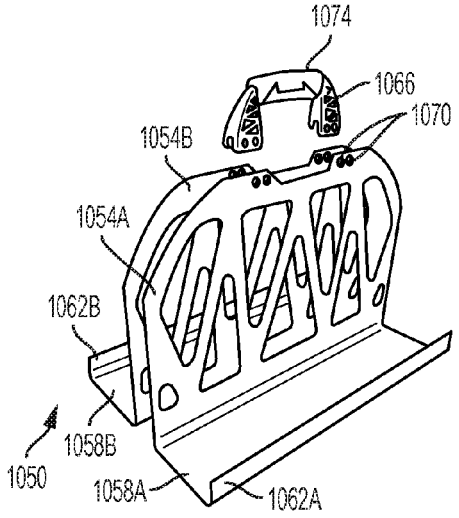
FIG. 2 is a perspective view of an inner casing of the tool bag shown in FIG. 1.

As shown in FIGS. 1-2 (see also FIG. 29), a frame or an inner casing 1050 in the storage space 1046 maintains the tool bag 1010 upright, provides increased support and durability, etc. The illustrated inner casing 1050 includes two stamped aluminum center spines 1054A, 1054B, each having a base 1058A, 1058B and a lip 1062A, 1062B. The base 1058A, 1058B provides for sturdy storage of tools and accessories, and the lip 1062A, 1062B contributes to the stability of the tool bag 1010. In other embodiments, the inner casing 1050 may be formed of other suitable materials and/or other suitable manufacturing processes. In other embodiments, the inner casing 1050 may be formed as an integral unit.

A handle 1066 couples the center spines 1054A, 1054B with a plurality of rivets 1070 or other suitable fasteners. The handle 1066 extends through the top panel 1034 to provide a sturdy location for a user or lifting device to grab the tool bag 1010. The handle 1066 is shaped and contoured as a comfortable location for the user to grip the tool bag 1010 during loading, unloading, transport, etc. The illustrated handle 1066 includes a grip portion 1074 formed of rubber, an elastomeric material, another suitable material or combination of materials.

Figure 3A:
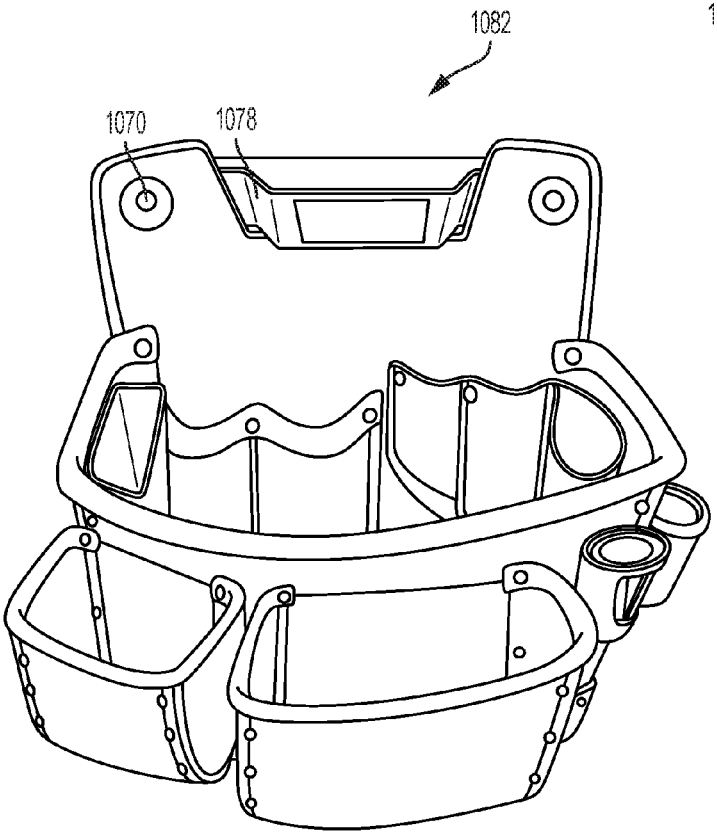
FIG. 3A is a front perspective view of a tool pouch compatible with the tool bag shown in FIG. 1 and with a tool belt shown in FIG. 4.
Figure 3B:
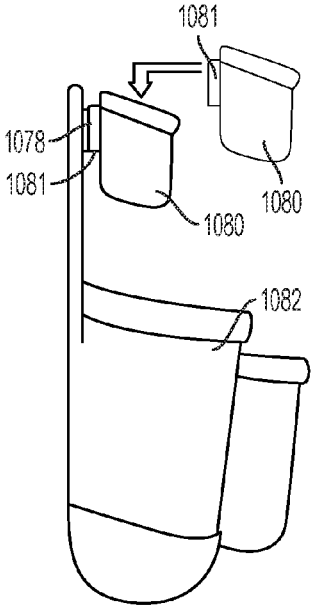
FIG. 3B is a side view of a portion of the tool pouch shown in FIG. 3A and illustrates a tool pocket.
Figure 4:
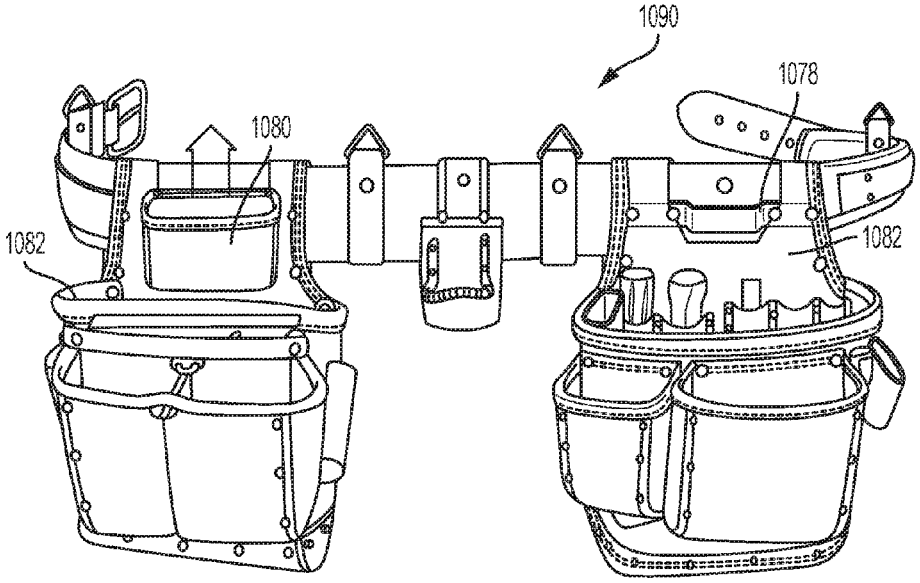
FIG. 4 is front perspective view of a tool belt including tool pouches and tool pockets and compatible with the tool bag shown in FIG. 1.

The center spine 1054A, 1054B includes brackets 1078 (FIG. 1) configured to receive and support a tool pocket 1080 (FIGS. 3B and 4). Each bracket 1078 is coupled to the center spine 1054A, 1054B with a rivet 1070 or other suitable fastener through an aperture (not shown) at a connection location 1086. The brackets 1078 may be used to hold or store tools and/or accessories without the pocket 1080 (see FIG. 29).

The illustrated brackets 1078 are integrally formed as a single piece. However, in other embodiments, each bracket 1078 may be separate from the other brackets. The brackets 1078 are illustrated in a substantially straight line but may be staggered to accommodate different sized tool pockets 1080. In some embodiments, the brackets 1078 may be different sizes to accommodate different sized tool pockets 1080. In some embodiments, a bracket 1078 may be integral with a tool pouch 1082 (FIG. 3A).

Each tool pocket 1080 includes a flange 1081 (FIG. 3B) configured to fit through the brackets 1078 of the tool bag 1010 and/or a tool pouch 1082 to anchor the tool pocket 1080. The tool pockets 1080 and tool pouches 1082 store and hold a plurality of tools and/or accessories. The pouches 1082 and pockets 1080 are removably interchangeable to couple to the tool bag 1010, a tool belt 1090 (FIG. 4), or other suitable device. The pocket 1080 and the pouches 1082 may be placed into the tool bag 1010 without being coupled to the bracket 1078 or center spine 1054A, 1054B.

The front panel 1018 of the tool bag 1010 includes a zipper 1094 (FIGS. 1 and 5) about three sides to permit exposure of the storage space 1046. When the front panel 1018 is unzipped, the storage space 1046 is accessible to insert or remove tools/accessories, tool pouches 1082, tool pockets 1080. Although illustrated as a zipper 1094, another suitable closure mechanism (e.g., snaps, buttons, buckles, other fasteners) may be used. Furthermore, one or more panels 1014-1034 may be adapted to provide access to the storage space 1046 in the tool bag 1010.

Figure 6:
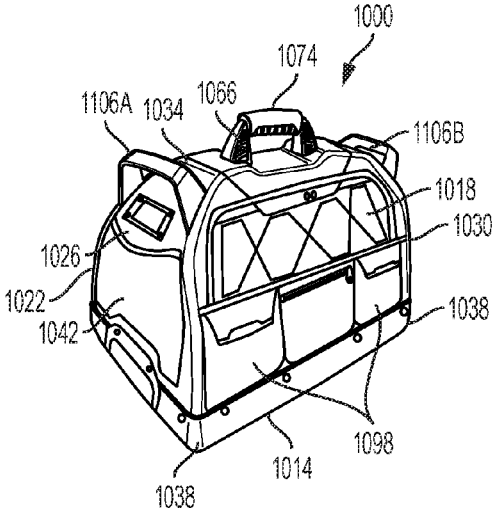
FIG. 6 is a front perspective view of a tool bag according to another independent embodiment.

As shown in FIG. 6, any of the panels 1014-1034 may include one or more exterior pockets 1098 or storage areas. The exterior pockets 1098 may be zippered, snapped, buttoned, or otherwise configured to provide access to the contents of the exterior pocket 1098.

Figure 5:
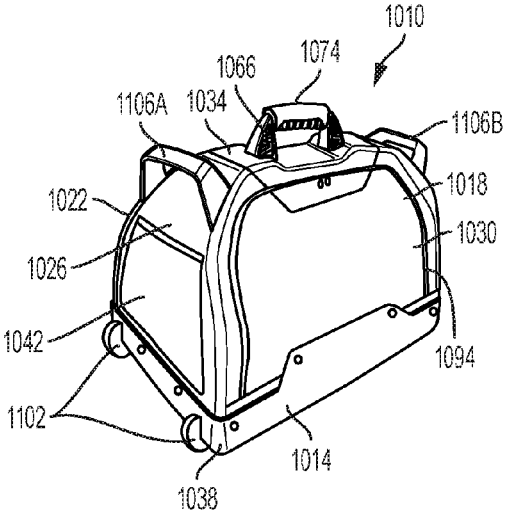
FIG. 5 is a front perspective view of a tool bag according to another independent embodiment.

As shown in FIG. 5, the tool bag 1010 may include a plurality of wheels 1102 to increase portability. The tool bag 1010 may also include a telescoping handle (not shown) on a side opposite the wheels 1102 to reduce bending of the user. Side handles 1106A, 1106B (FIGS. 1 and 5-6) extend from the tool bag 1010 at a location where the top panel 1034 meets each end panel 1026, 1030. The handles 1106A, 1106B may be used for transport, to hang the tool bag 1010 horizontally (e.g., from a railing), etc.

FIGS. 7-10 illustrate a tool storage device 3020, such as a generally rigid toolbox, including a container 3024 and a lid 3028. The container 3024, or base, includes a bottom wall 3032 and four sidewalls 3036, 3040, 3044, 3048 extending generally perpendicularly from the bottom wall 3032. The bottom wall 3032 and the sidewalls 3036-3048 together define a storage area 3052 (FIG. 13) of the toolbox 3020. The cover or lid 3028 is pivotally coupled to the container 3024 to open (FIGS. 12 and 14) and close (FIGS. 7 and 8) the toolbox 3020. In the illustrated embodiment, the container 3024 and the lid 3028 are made of a rigid, molded plastic material but may be made of other suitable materials, such as metal.

Figure 7:
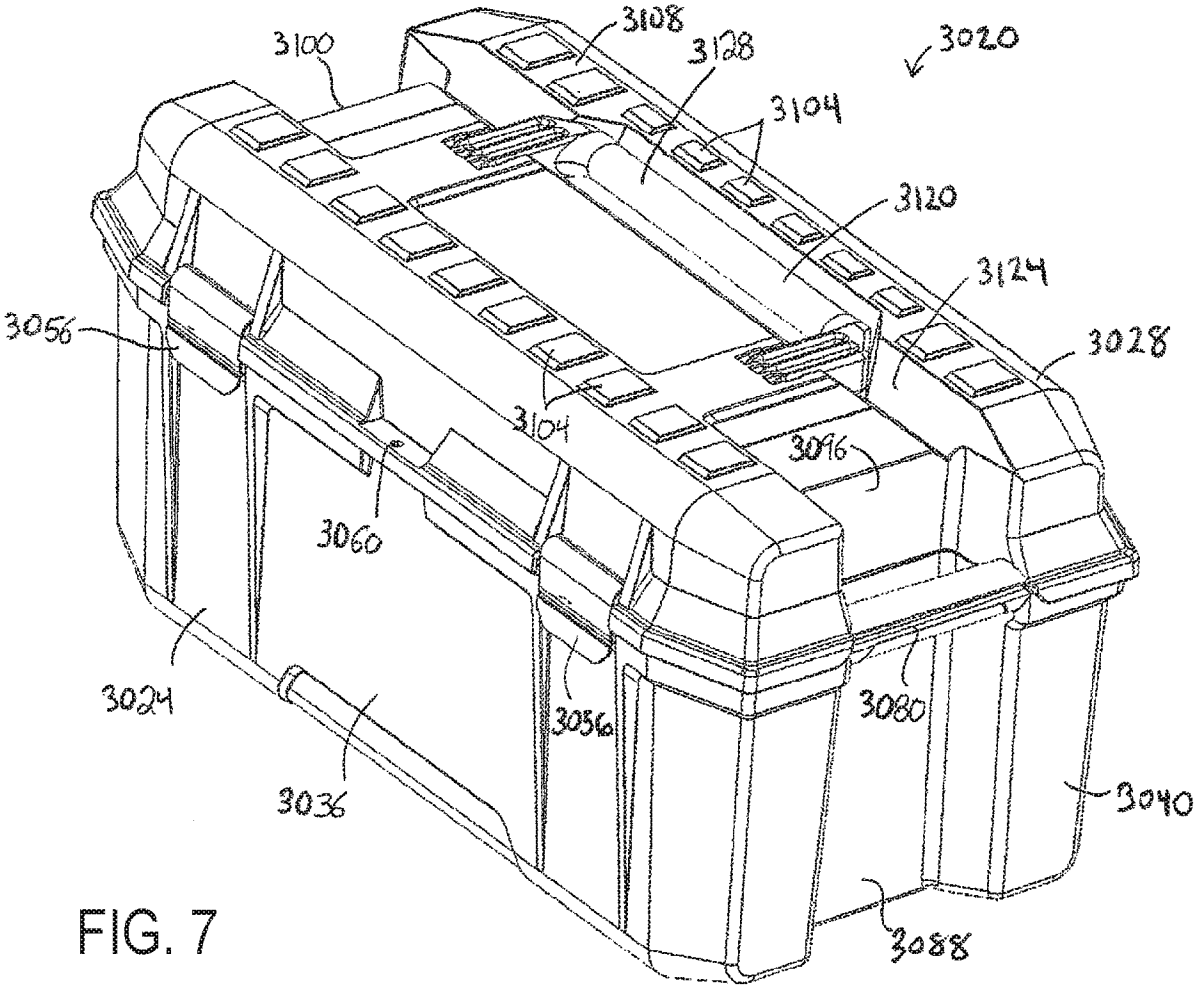
FIG. 7 is a front perspective view of a tool storage device, such as a tool box, according to another independent embodiment, illustrated in a closed position.

As shown in FIG. 7, the lid 3028 includes two latches 3056 pivotally movable relative to the lid 3028 to selectively engage corresponding portions of the container 3024. Each latch 3056 includes a rib or protrusion that slides underneath a corresponding lip of the container 3024 to secure the lid 3028 in a closed position. The lid 3028 also defines an opening 3060 that aligns with an opening in the container 3024, and the openings are configured to receive a padlock, cable, clip, or other suitable device to retain or lock the lid 3028 in the closed position.

Figure 8:
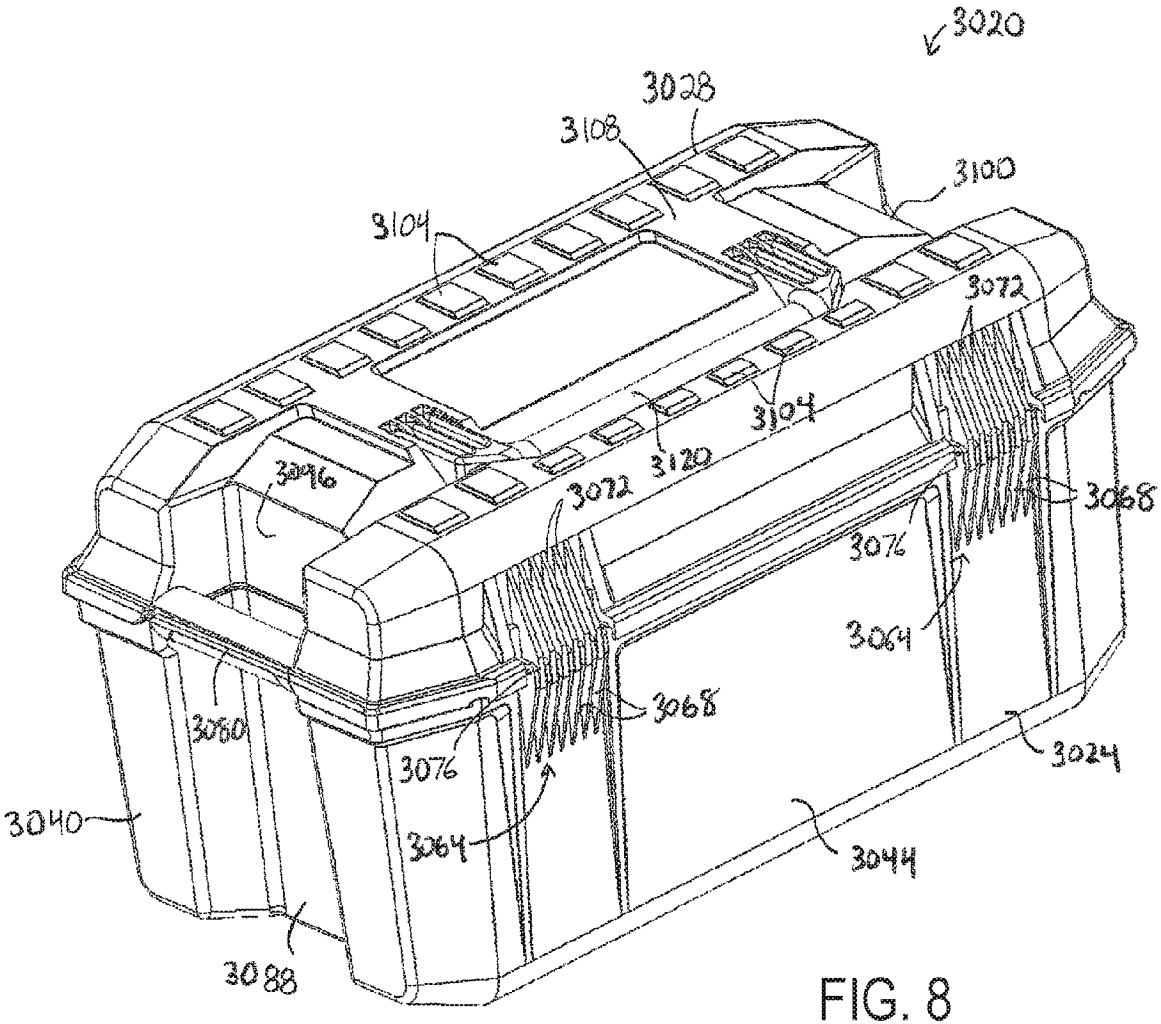
FIG. 8 is a rear perspective view of the device of FIG. 7.

As shown in FIG. 8, the lid 3028 is pivotally coupled to the container 3024 by two buttress hinges 3064. Each buttress hinge 3064 includes a series of spaced apart first flanges 3068 extending from the container 3024, and a series of spaced apart second flanges 3072 extending from the lid 3028. The flanges 3068, 3072 are interspersed such that each flange 3072 of the lid 3028 is positioned between two adjacent flanges 3068 of the container 3024. A pin 3076 extends through the flanges 3068, 3072 of each hinge 3064 to pivotally couple the flanges 3068, 3072 and, thereby, the container 3024 and the lid 3028. The flanges 3068, 3072 provide a relatively smooth hinge to reduce the possibility of snagging. In addition, the flanges 3068, 3072 provide a relatively strong hinge that inhibits the lid 3028 from opening more than 180 degrees relative to the container 3024.

As shown in FIGS. 7-10, in the closed position, the container 3024 and the lid 3028 define handles 3080, 3084 on opposing sides of the toolbox 3020. The sidewalls 3040, 3048 of the container 3024 define recessed areas 3088, 3092 to provide clearance for gripping the handles 3080. Similarly, sidewalls of the lid 3028 also define recessed areas 3096, 3100 aligned with the corresponding recessed areas 3088, 3092 of the container 3024 to provide clearance for gripping the handles 3080. The recessed areas 3088, 3092, 3096, 3100 allow a user's hand to pass between the handles 3080, 3084 and the container 3024 and the lid 3028 to facilitate grasping and carrying the toolbox 3020. In addition, the recessed areas 3088, 3092, 3096, 3100 allow a user to thread a cable or padlock around the handles 3080, 3084 to retain or lock the toolbox 3020 in the closed position and/or to a surrounding structure (e.g., a work bench). The handles 3080, 3084 are thereby pass-through handles that allow hands or other objects to pass between the handles 3080, 3084 and the container 3024 and the lid 3028.

Figure 9:
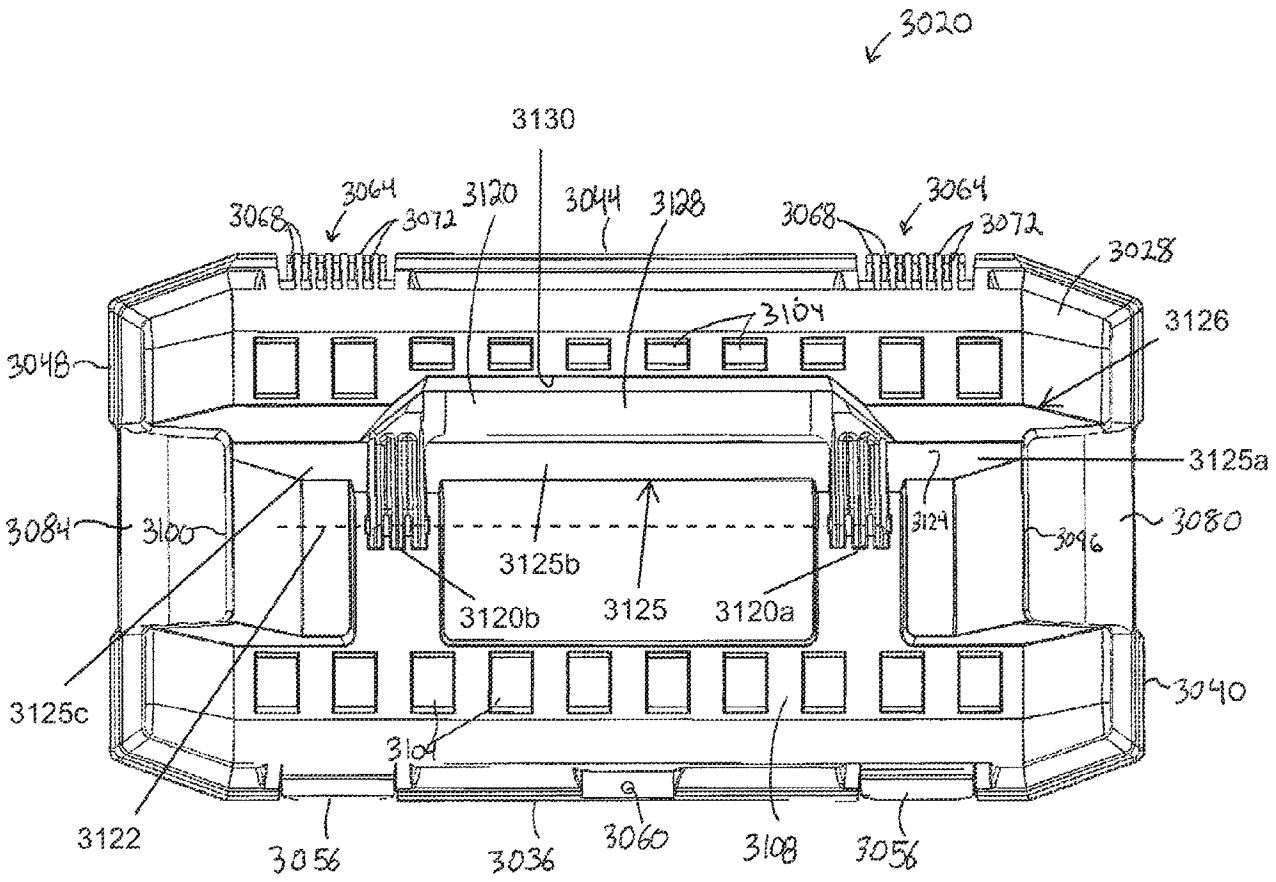
FIG. 9 is a top view of the device of FIG. 7.
Figure 10:
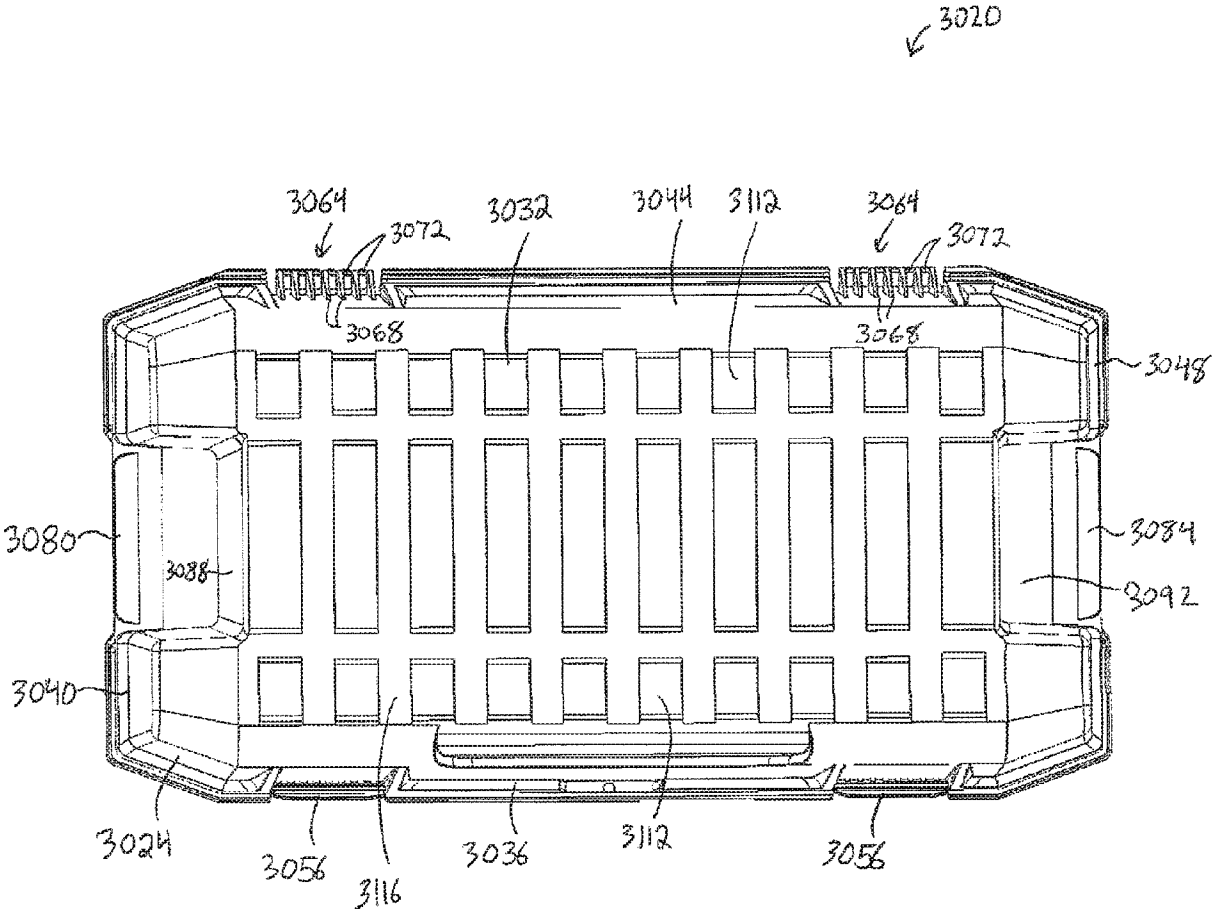
FIG. 10 is a bottom view of the device of FIG. 7.

As shown in FIG. 9, the lid 3028 includes detents 3104 formed in an outer surface 3108. In the illustrated embodiment, the detents 3104 are raised rectangles that extend upwardly from the surface 3108 but may have other shapes or sizes and/or be arranged in other patterns. The illustrated detents 3104 are configured to be received in corresponding recesses 3112 (FIG. 10) in a lower surface 3116 of the container 3024. The detents 3104 fit within the recesses 3112 to help stack multiple toolboxes on top of each other. The detents 3104 and the recesses 3112 inhibit the toolboxes from shifting relative to one another when stacked. The detents 3104 and the recesses 3112 can also correspond with and engage detents and/or recesses of other storage products, such as large storage chests, soft-sided tool bags, etc.

Figure 11:
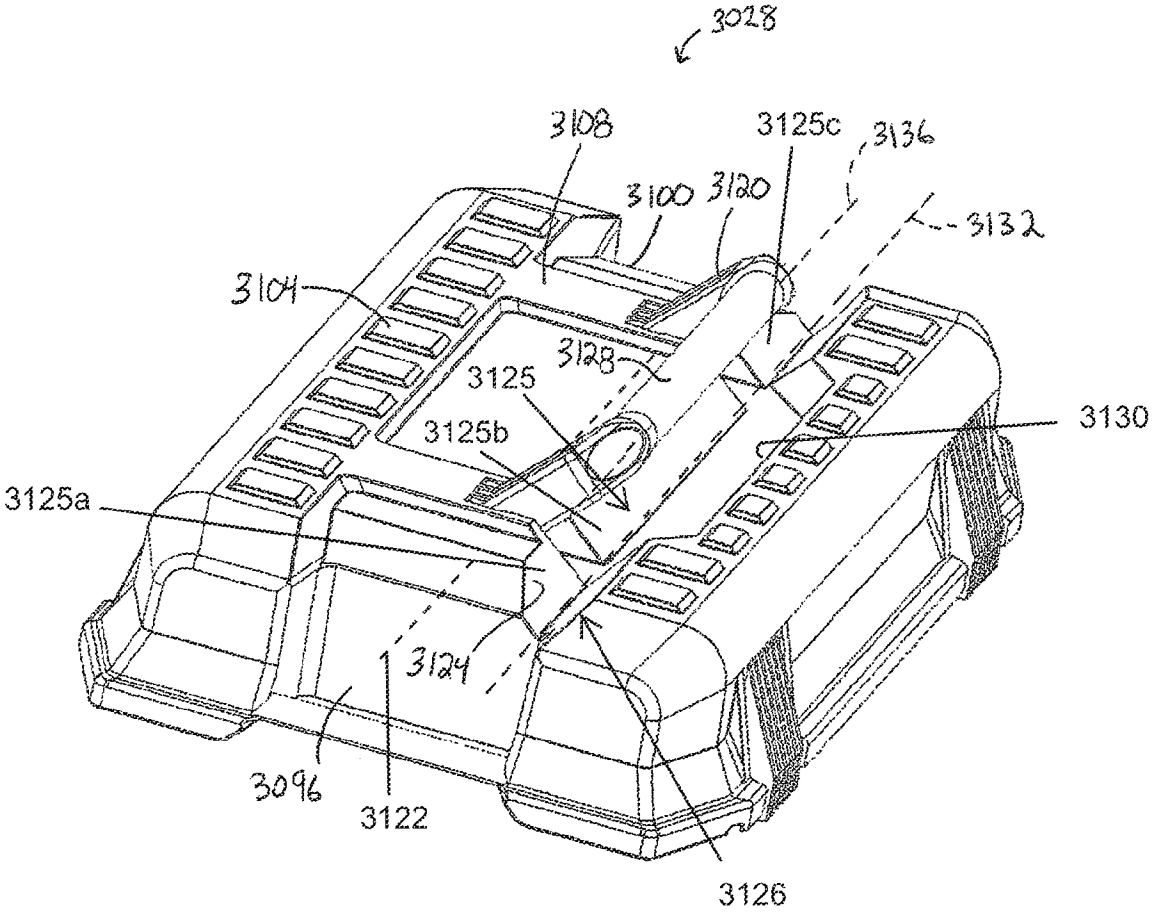
FIG. 11 is a perspective view of a lid of the device of FIG. 7.

As shown in FIG. 11, the lid 3028 also includes a handle 3120 and a groove 3124 formed in the outer surface 3108. The handle 3120 is pivotally coupled to the lid 3028 and movable between a lowered, storage position (FIG. 7) and a number of raised, operating positions (one of which is shown in FIG. 11). When the handle 3120 is in the storage position, the handle 3120 is generally flush with or recessed relative to the outer surface 3108 of the lid 3028. The handle 3120 has a first handle end 3120*a* and a second handle end 3120*b* pivotally coupled to the lid 3028. The handle 3120 is pivotable about a pivot axis 3122 parallel to the length of the lid 3028. Each handle end 3120*a*, 3120*b* has opposite sides along the pivot axis 3122, such that the handle 3120 is pivotally supported by the lid 3028 on both opposite sides of each handle end 3120*a*, 3120*b*. The handle 3120 includes a grip portion 3128 configured to be grasped by a user to facilitate carrying the toolbox 3020. In some embodiments, the grip portion 3128 may be covered or coated with a rubber or elastomeric material.

The illustrated groove 3124 extends longitudinally across the outer surface 3108 of the lid 3028 adjacent the handle 3120. In particular, a longitudinal axis 3132 of the groove 3124 is generally parallel to a longitudinal axis 3136 of the grip portion 3128 of the handle 3120, regardless of the pivoted position of the handle 3120. The illustrated groove 3124 has a generally V-shaped cross-sectional shape but may have other suitable cross-sectional shapes, such as a semi-circular cross-sectional shape. The groove 3124 has a proximal groove wall 3125 positioned closer to the pivot axis 3122 than an opposite distal groove wall 3126. The proximal groove wall 3125 and the distal groove wall 3126 define the V-shaped cross-sectional shape. The proximal groove wall 3125 has a first portion 3125*a* between the first handle end 3120*a* and the wall 3040, an intermediate portion 3125*b* between the handle ends 3120*a*, 3120*b*, and a second portion 3125*c* between the second handle end 3120*b* and the wall 3048. In the storage position, the handle 3120 extends from the pivot axis 3122 to a position beyond the distal groove wall 3126 and into a handle receiving recess 3130 defined by the outer surface of the lid 3028. The groove 3124 is configured to receive an elongated work piece, such as a pipe, conduit, etc., for cutting. When a work piece is positioned within the groove 3124, the handle 3120 can be pressed against the work piece to clamp and hold it in place, and a user can then cut the work piece. If the grip portion 3128 of the handle 3120 is covered with a rubber or elastomeric material, the handle 3120 can help grip the work piece to inhibit it from slipping relative to the lid 3028.

Figure 12:
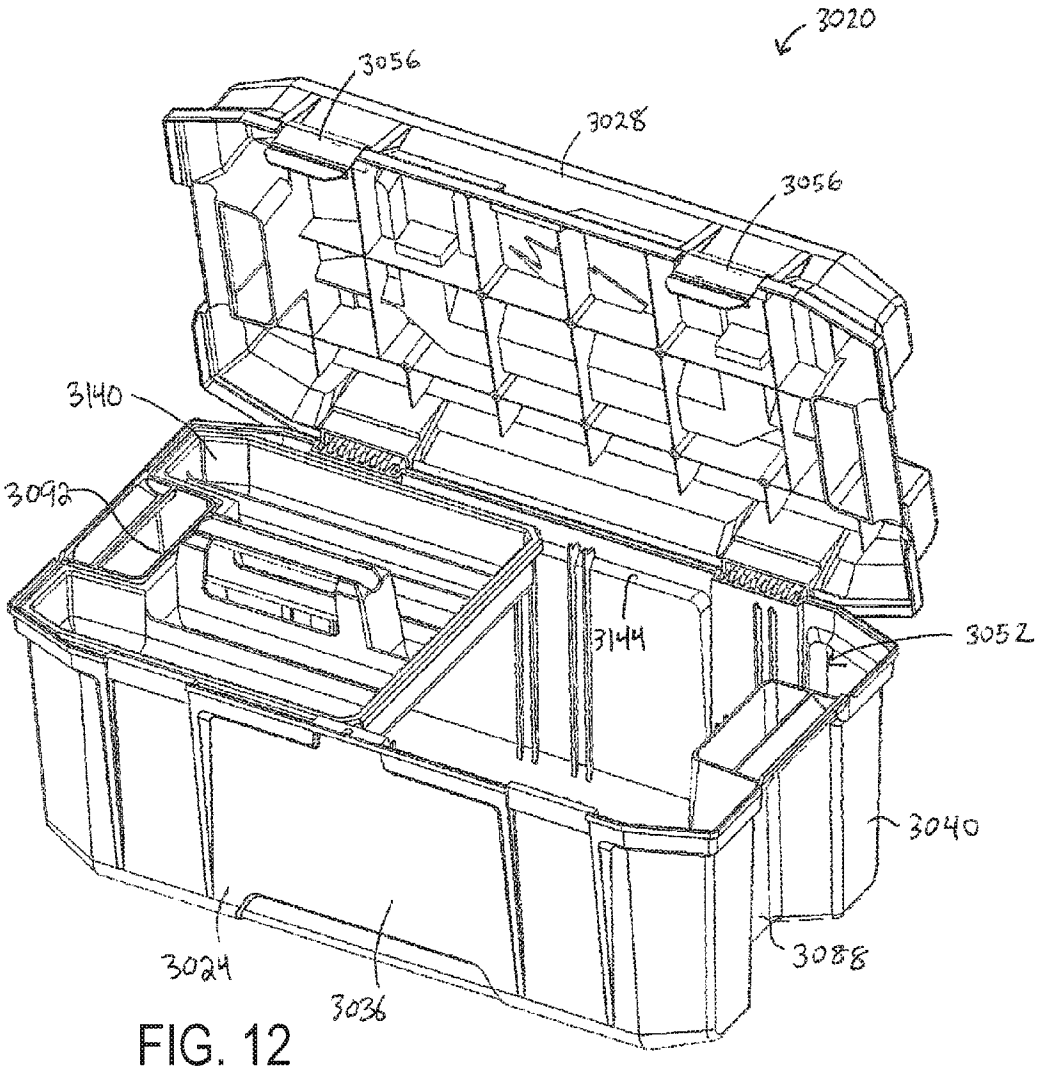
FIG. 12 is a front perspective view of the device of FIG. 7, illustrated in an open position.

As shown in FIG. 12, the toolbox 3020 also includes a storage tray 3140 positioned within the storage area 3052 of the container 3024. The storage tray 3140 is supported on a shelf 3144 of the container 3024 near the uppermost portion of the storage area 3052 (i.e., near the lid 3028). The storage tray 3140 can be removed from the container 3024 and repositioned within the container 3024 in one or more positions (e.g., two positions—the illustrated position in the left side of the container 3024 and a corresponding position in the right side of the container 3024).

Figure 13:
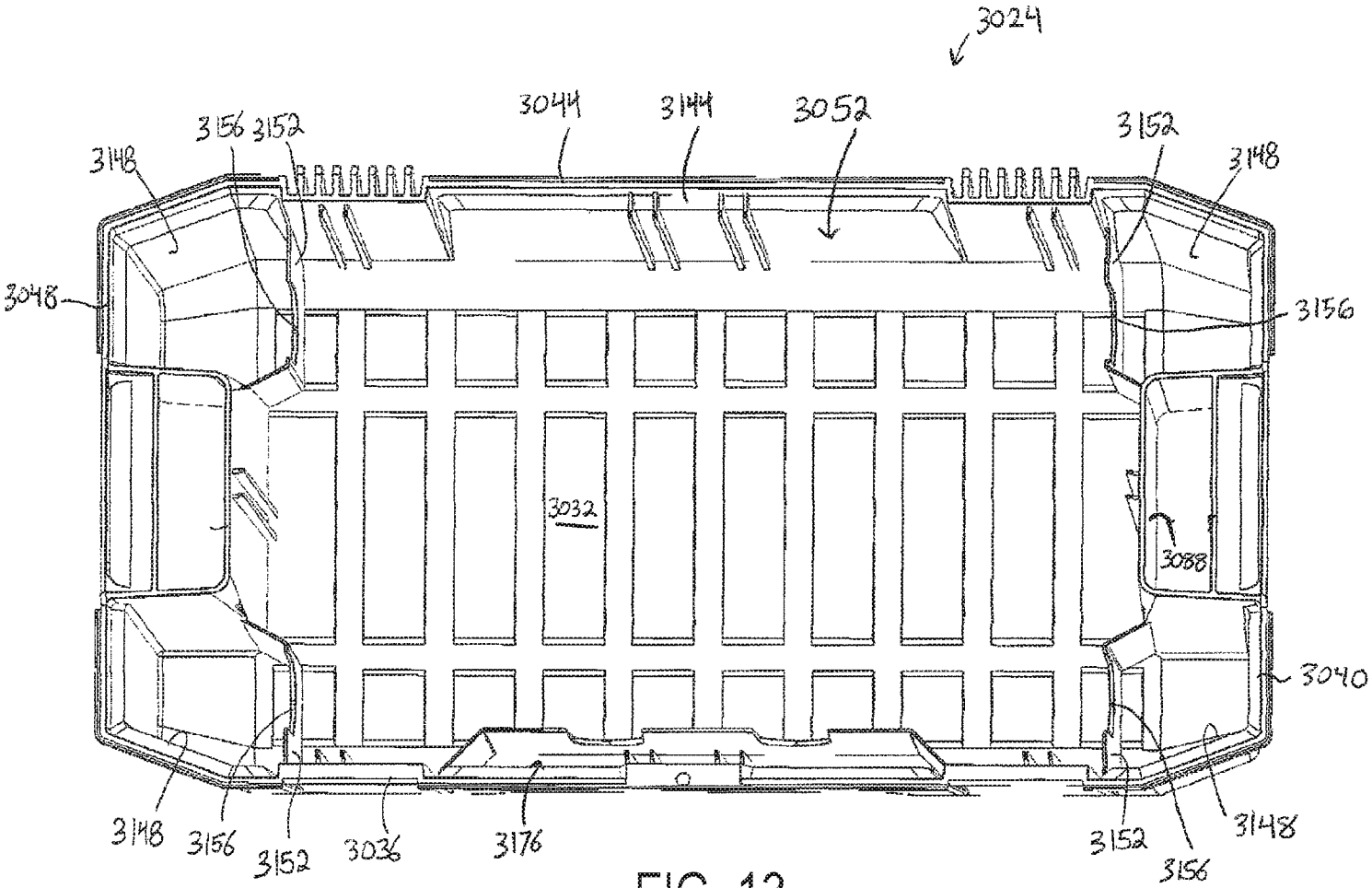
FIG. 13 is a top view of a container of the device of FIG. 7.
Figure 15:
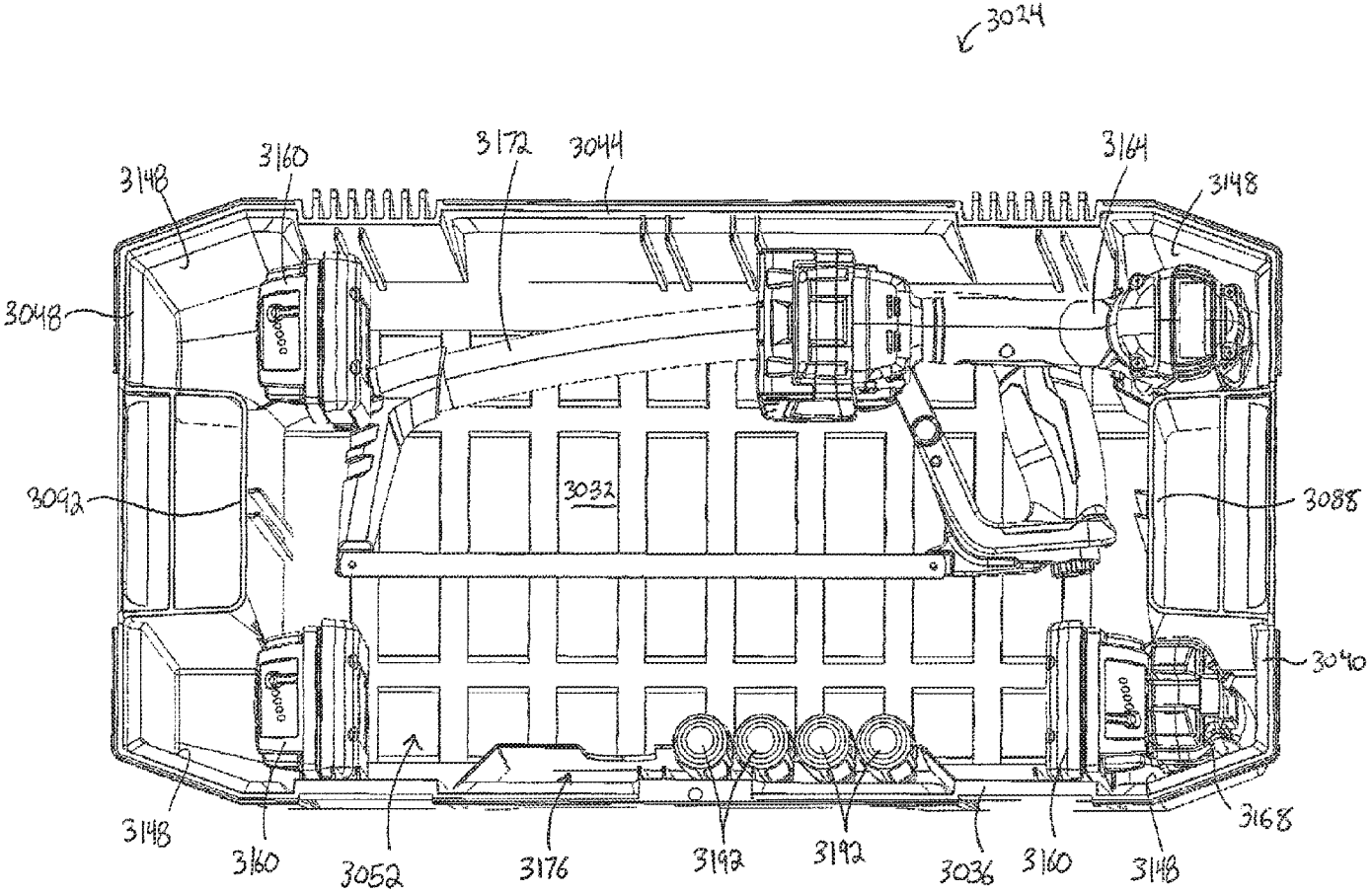
FIG. 15 is a top view of the container of FIG. 13, illustrated with various tools positioned within the container.

As shown in FIG. 13, the container 3024 includes four corner pockets 3148 in the storage area 3052. The corner pockets 3148 are defined between the sidewalls 3036-3048 and the recessed areas 3088, 3092 of the container 3024. Each corner pocket 3148 is further defined by an interior partition 3152 that extends from the sidewalls 3036, 3044 to one of the recessed areas 3088, 3092. The pockets 3148 are configured to receive tools, battery packs, or other devices to help organize items within the storage area 3052. Each interior partition 3148 defines a semi-circular cutout 3156 configured to receive a portion of a battery pack 3160 to support the battery pack 3160, as shown in FIG. 15. The interior partitions 3152 also provide structural support to the container 3024 reducing the possibility of fracturing when the toolbox 3020 is formed of a relatively malleable material.

Figure 14:
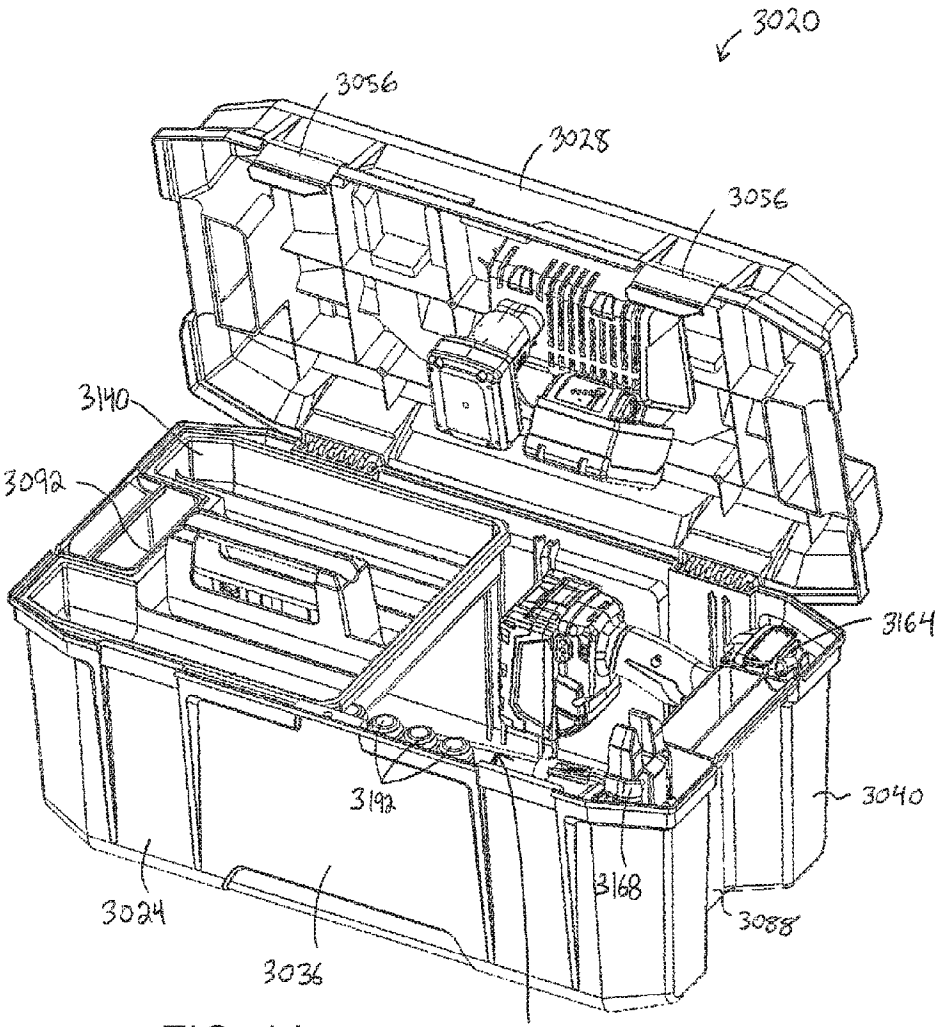
FIG. 14 is a front perspective view of the device of FIG. 7, illustrated in the open position and with various tools positioned within the device.

FIGS. 14-15 illustrate the toolbox 3020 in an open position with a variety of tools stored within the container 3024. For example, as shown in FIG. 15, a drill 3164 is partially positioned in one corner pocket 3148, and a fork meter 3168 is positioned in another corner pocket 3148. In addition, three battery packs 3160 are supported by three interior partitions 3152. A handsaw 3172 is also positioned to lie flat on the bottom wall 3032 of the container 3024 within the storage area 3052.

Figure 16:
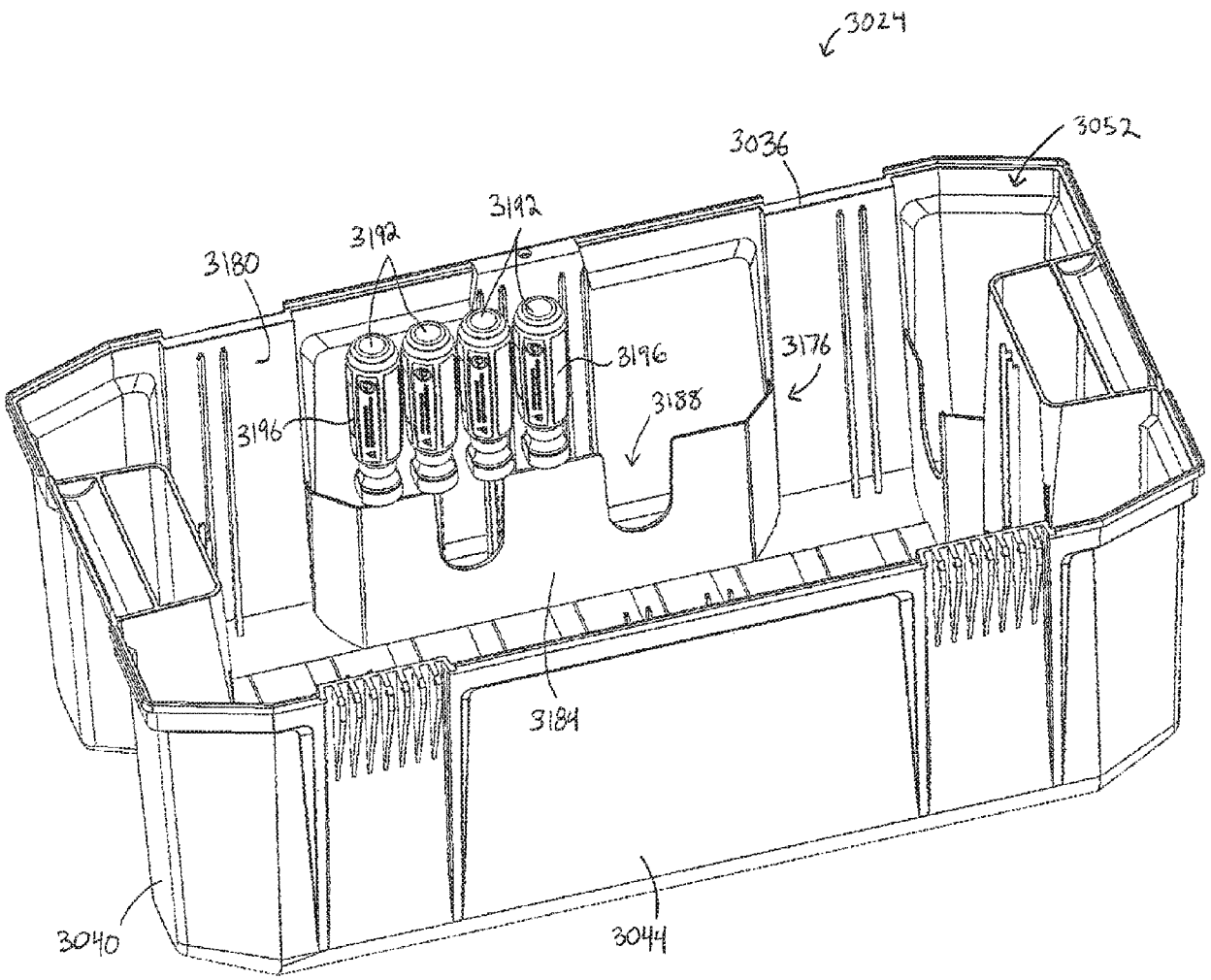
FIG. 16 is a rear perspective view of the container of FIG. 13, illustrated with various tools positioned within the container.

As shown in FIG. 16, the container 3024 includes a barrel storage area 3176 formed on an interior side 3180 of the sidewall 3036. The barrel storage area 3176 is defined by an inner wall 3184 of the container 3024. The inner wall 3184 extends inwardly from the sidewall 3036 to define a space 3188 between the sidewall 3036 and the inner wall 3184. The space 3188 is configured to receive hand tools, such as screwdrivers 3192, personal effects, etc. In the illustrated embodiment, the inner wall 3184 is sized to engage a handle 3196 of each screwdriver 3192 such that the screwdrivers 3192 are supported in an upright position within the barrel storage area 3176.

Figure 17:
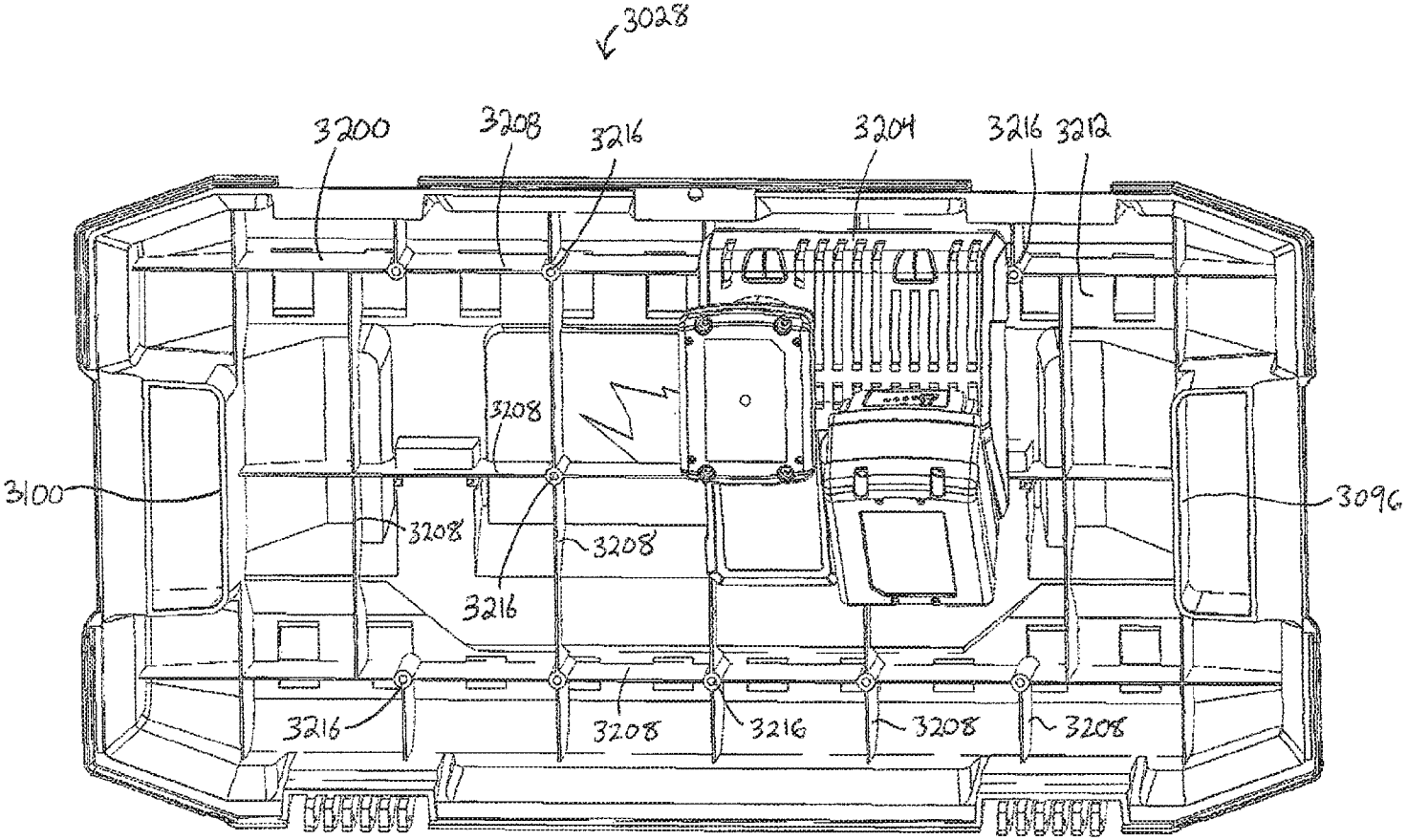
FIG. 17 is a bottom view of the lid of FIG. 11, illustrated with a battery charger coupled to the lid.
Figure 18:
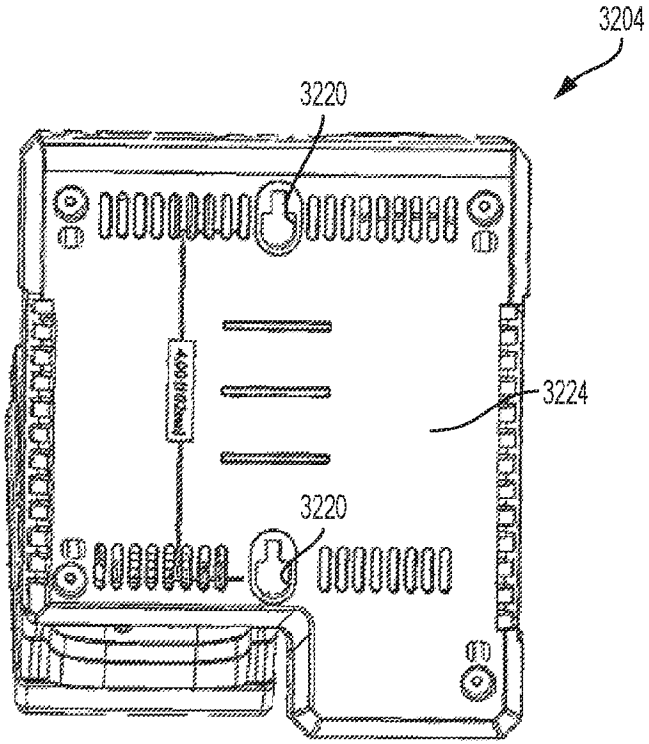
FIG. 18 is a bottom view of the battery charger shown in FIG. 17.

As shown in FIG. 17, the lid 3028 includes a mounting structure 3200 for supporting a battery charger 3204. The illustrated mounting structure 3200 includes ribs 3208 extending from an inner surface 3212 of the lid 3028. The ribs 3208 intersect at right angles to form a grid-like structure. Screw bosses 3216 are formed at the intersections of some of the ribs 3208. The screw bosses 3216 receive screws, or other fasteners, to mount the battery charger 3204 to the lid 3028. For example, as shown in FIG. 18, the battery charger 3204 includes two keyhole slots 3220 formed in a bottom surface 3224 and normally used to mount the battery charger 3204 to a wall. The keyhole slots 3220 engage two screws extending from the screw bosses 3216 of the lid 3028 (FIG. 17) to mount the charger 3204 to the lid 3028. When mounted to the lid 3028, the battery charger 3204 moves (e.g., pivots) with the lid 3028 relative to the container 3024 but is still stored within the storage area 3052 of the container 3024 when the lid 3028 is closed. The battery charger 3204 can be removed from and repositioned on the lid 3028, depending on the availability of other screw bosses 3216.

In some embodiments, the storage tray 3140 may also include keyhole slots to mount the tray 3140 to the mounting structure 3200. In further embodiments, other devices, such as cord wraps, lights, magnets, etc., may also or alternatively be mounted to the lid 3028 using the illustrated mounting structure 3200.

Figure 19:
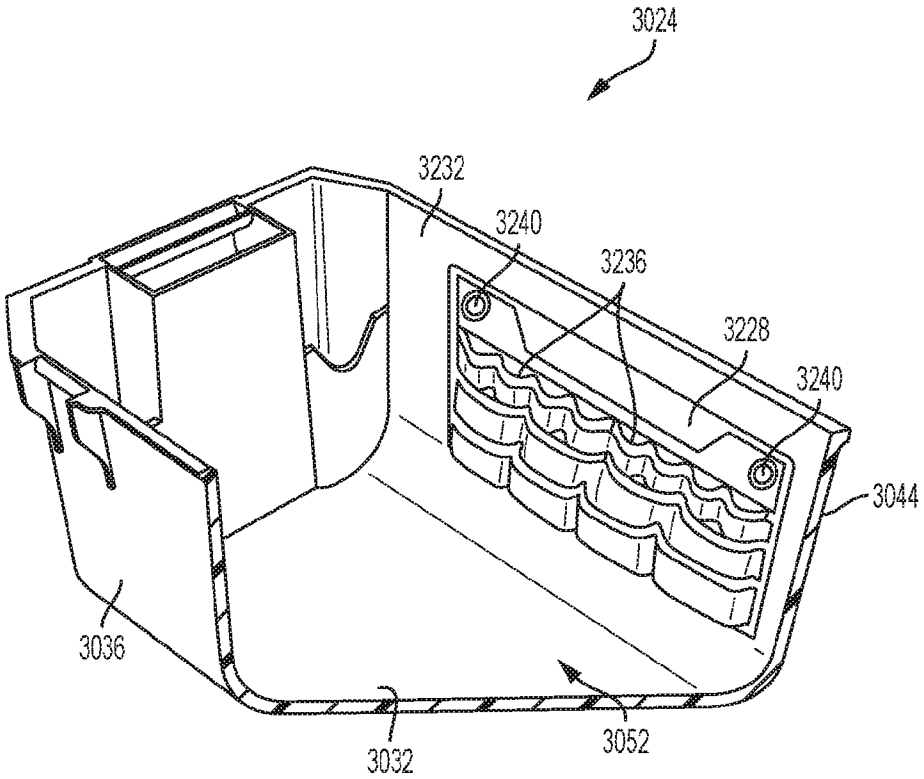
FIG. 19 is a cross-sectional perspective view of the container of FIG. 13, illustrated with a tool organizer.

As shown in FIG. 19, the toolbox 3020 also includes a tool organizer 3228 coupled to an interior side 3232 of the sidewall 3044 of the container 3024. The illustrated tool organizer 3228 is a fabric pouch including a plurality of pockets 3236 to receive different types of tools, bits, or other devices. The tool organizer 3228 is removably mounted to the container 3024 by openings 3240 that receive rivets, hooks, bosses, or other projections extending inwardly from the sidewall 3044.

In some embodiments, the toolbox 3020 may a water-tight and, in such embodiments, may not include any ingress or egress holes. In addition, the container 3024 and the lid 3028 may be formed by a two-shot injection molding process to provide a relatively elastic material that creates a seal at an interface between the container 3024 and the lid 3028. Alternatively, the toolbox 3020 may include an O-ring, gasket, or other elastomeric member located at the interface between the container 3024 and the lid 3028. In other embodiments, the toolbox 3020 may not be water-tight such that water can flow out of the container 3024 and air can circulate through the storage area 3052.

Figure 20:
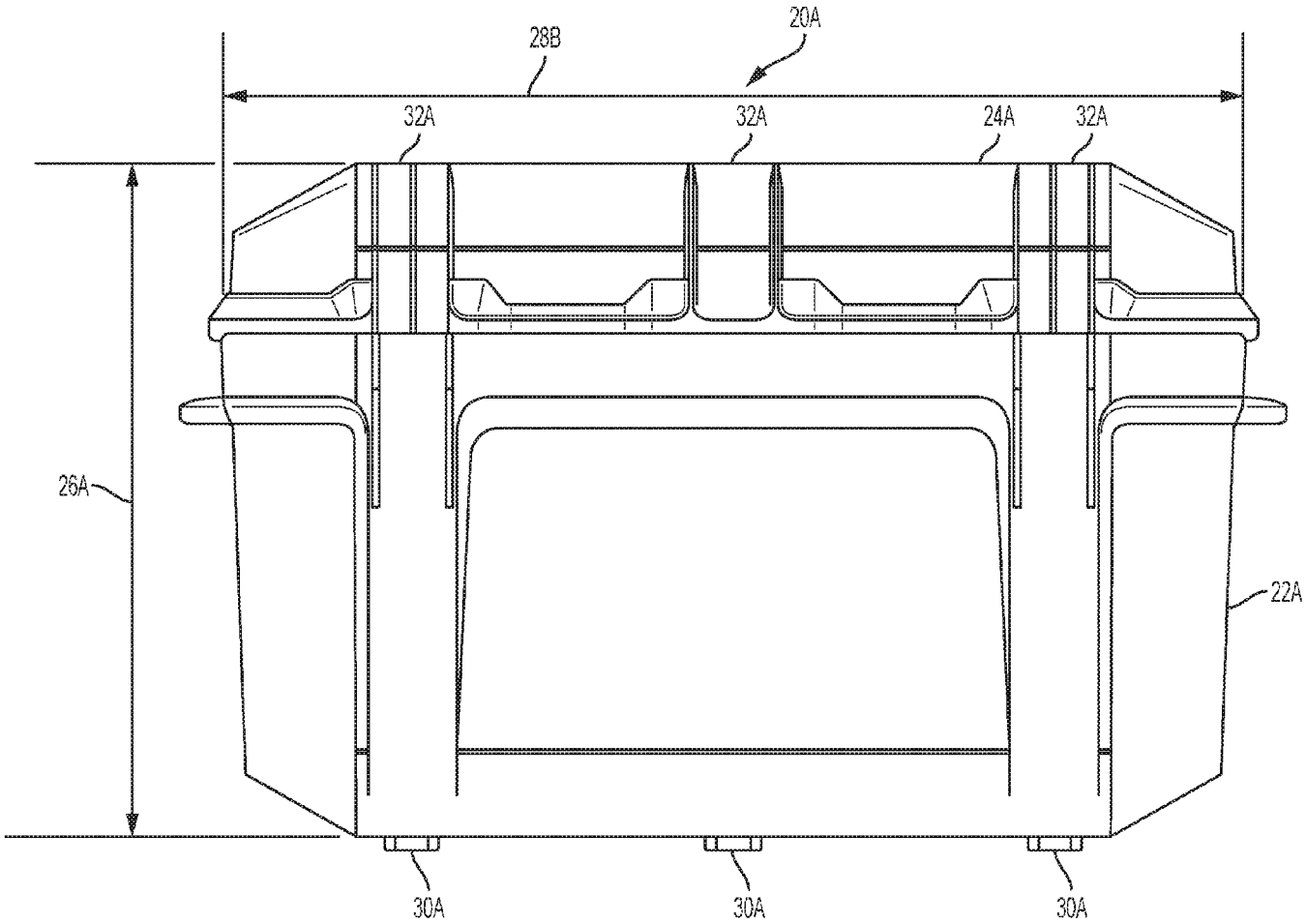
FIG. 20 is a side view of a tool storage device according to another independent embodiment.

FIG. 20 illustrates a tool storage device 20A, such as a generally rigid tool box, including a container 22A and a removable lid 24A. The tool box 20A has a height 26A and a width 28B. The container 22A includes equally-spaced projections 30A that extend from the bottom of the container 22A, and the top of the lid 24A includes complementarily-spaced recess 32A.

Figure 22:
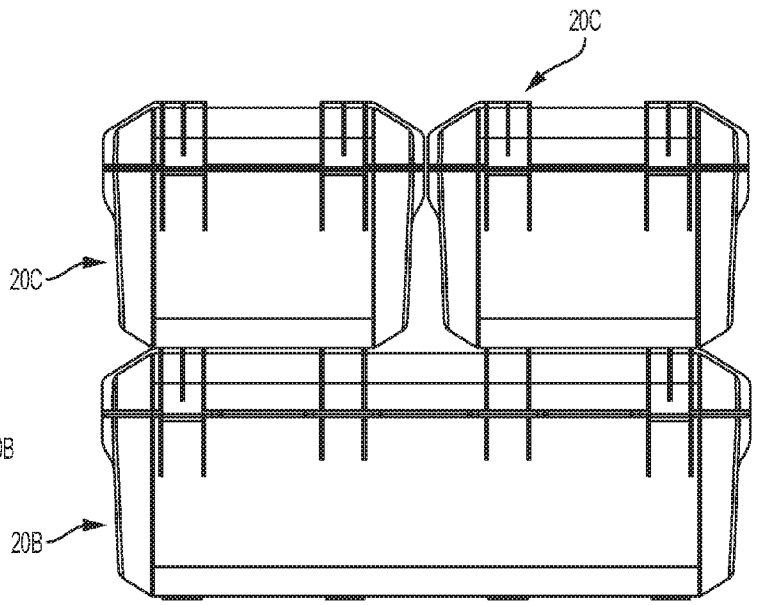
FIG. 22 is a side view of another plurality of tool storage devices according to independent embodiments of FIG. 23.
Figure 21:
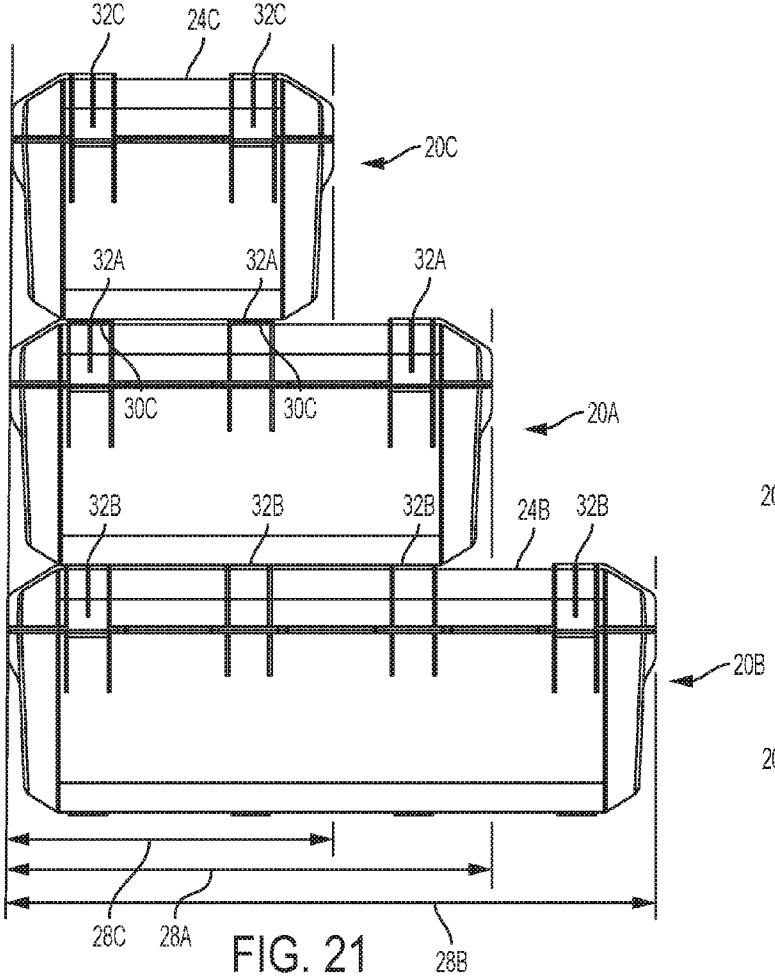
FIG. 21 is a side view of a plurality of tool storage devices according to independent embodiments.
Figure 23:
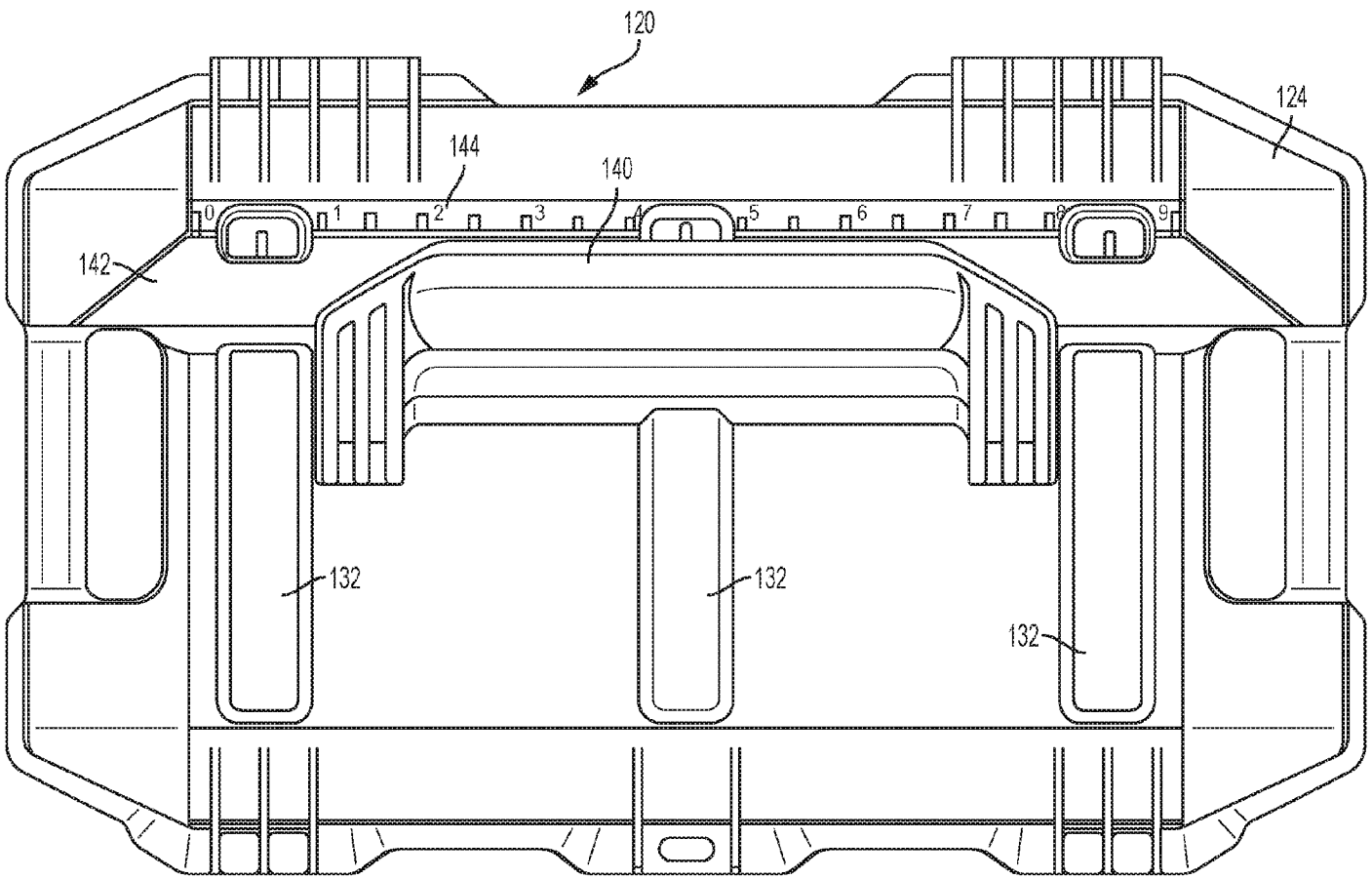
FIG. 23 is a top view of a tool storage device according to another independent embodiment.

Referring to FIGS. 21-22, the tool box 20A can be used as part of a set of tool boxes 20A-20C. The tool box 20B has a width 28B, and the width 28A of the box 20A is about two-thirds the width 28B of the box 20B. The box 20B includes a lid 24B with recesses 32B spaced and sized to receive projections 30A (FIG. 20) so that the tool box 20A can be securely stacked on top of and interlock with the box 20B.

The tool box 20C has a width 28C, and the width 28C of the box 20C is about one half the width 28B of the box 20B. The box 20C includes a lid 24C with recesses 32C and a container 20C with projections 30C spaced the same distance as the recess 32A, 32B. As illustrated in FIGS. 21-22, the box 20C can be securely stacked on either box 20A or 20B. The projections 30A, 30B, 30C can be received in the recesses 32A, 32B, 32C using a snap fit type connection to securely stack and interlock any suitable arrangement of boxes 20A, 20B, 20C.

FIGS. 23-26 illustrate a tool storage device 120, such as a generally rigid tool box, including a container 122 and a pivotable lid 124. The lid 124 includes recesses 132, similar to the recesses 32A, 32B, and 32C, discussed above, and the container 122 can include projections similar to the projections 30A, 30B, 30C, discussed above. The tool box 120 can thus be stacked with other tool boxes or the tool boxes 20A, 20B, 20C, as discussed above.

The lid 124 further includes a handle 140 pivotally coupled to the lid 124, a groove 142 adjacent the handle 140 and a ruler 144 adjacent and outside the groove 142. The handle 140, the groove 142, and the ruler 144 will be discussed in more detail below in regard to the embodiment of FIGS. 27-28.

Figure 24:
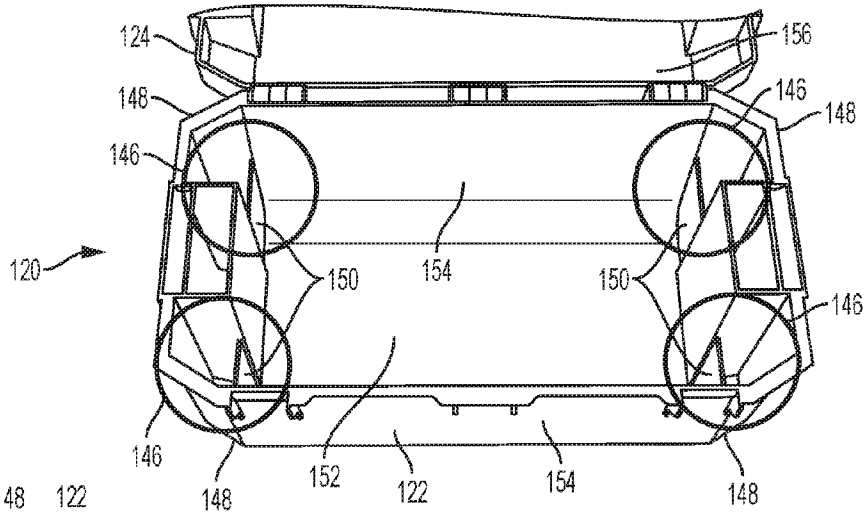
FIGS. 24-26 are perspective views of portions of the device of FIG. 23.
Figure 26:
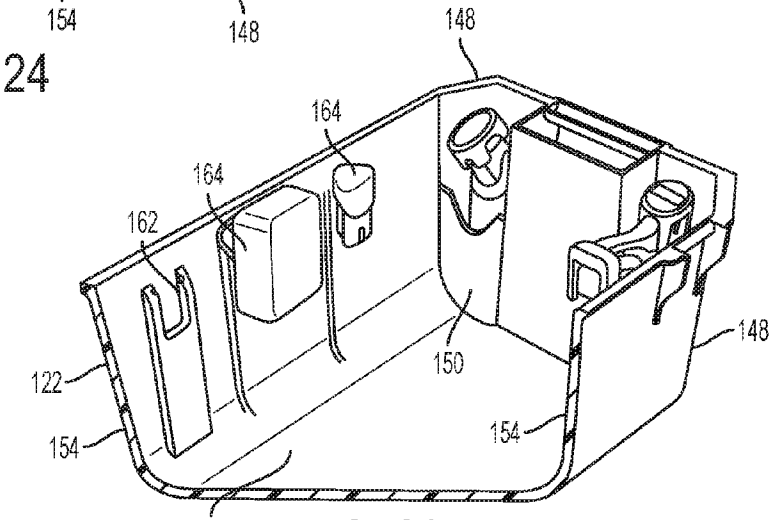
Figure 25:
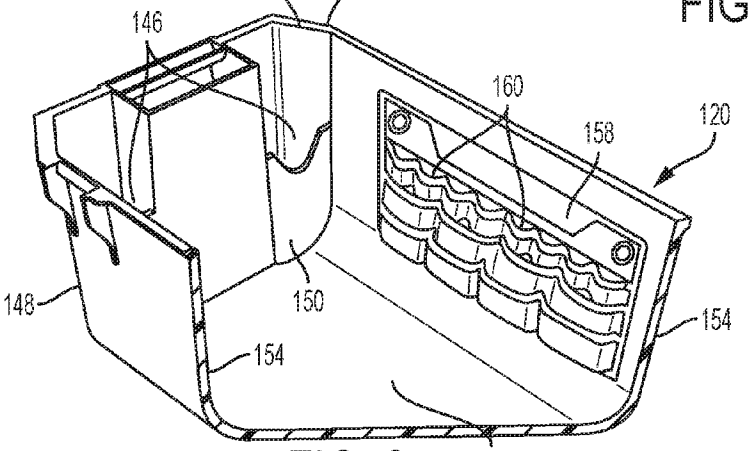

Referring to FIGS. 24-26, the container 122 includes storage compartments 146 formed at each corner 148. The compartments 146 are formed by a wall 150 that extends upwardly from a base 152 of the container 122. The walls 150 also attach to adjacent sidewalls 154 of the container 122. As illustrated in FIG. 25, the storage compartments 146 provide a place to store tools, such as, hand tools, flashlights, drills, etc. Also, the walls 150 in each corner 148 increase the rigidity and durability of the container 122.

An underside 156 (FIG. 24) of the lid 124 can include ridges or walls (not shown) to increase the rigidity of the lid 124, provide compartments for storing tools, fasteners, etc. A cover (not shown) can be provided for the underside 156 of the lid 124 to enclose such compartments. The cover may be provided with retaining members to prevent objects in one compartment from spilling into another compartment. As illustrated in FIG. 24, the lid 124 pivots open to a position generally parallel to the support surface, which would provide convenient access to any storage compartments on the underside 156 of the lid 124.

As illustrated in FIG. 26, the box 120 can include a removable soft organization panel 158. The panel 158 includes pockets 160 to store small items, such as hand tools, tool bits, etc., and can be hung on hooks, posts, other projections, etc. on one or more sidewalls 154 of the container 122. Further, the panel 158 can be removed and attached to a work belt, a second storage or tool box, a work surface, etc.

As illustrated in FIG. 25, the sidewall 154 can also include ribs or recesses 162 of different sizes corresponding to different size devices to be stored (e.g., power tool batteries 164). As illustrated in FIG. 25, the batteries 164 can be slid into the recess 162 to attach the batteries 164 to the sidewall 154 above the base 152 of the container 122.

Figure 27:
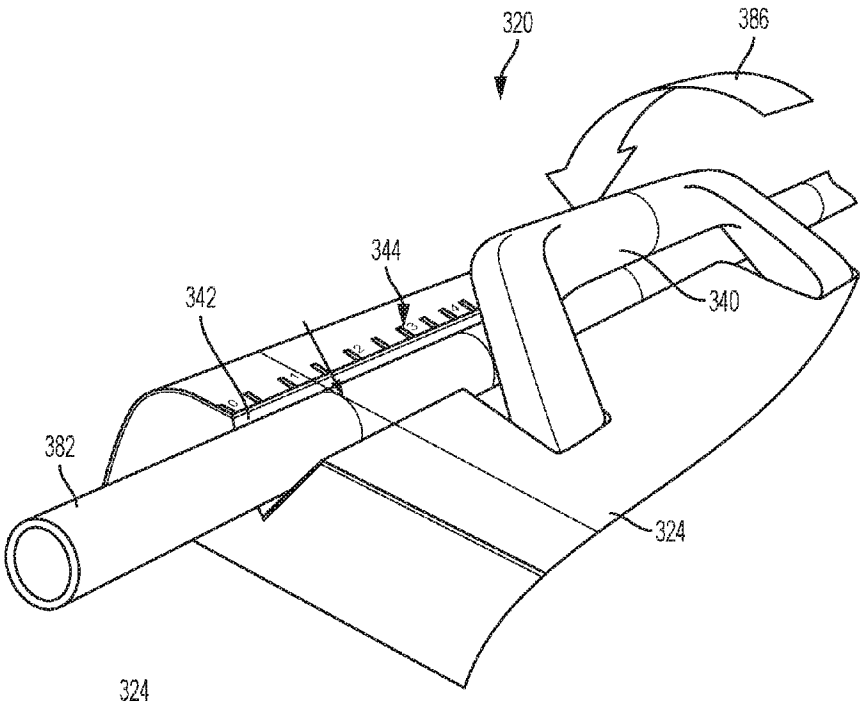
FIG. 27 is a perspective view of a portion of a tool storage device according to another independent embodiment.
Figure 28:
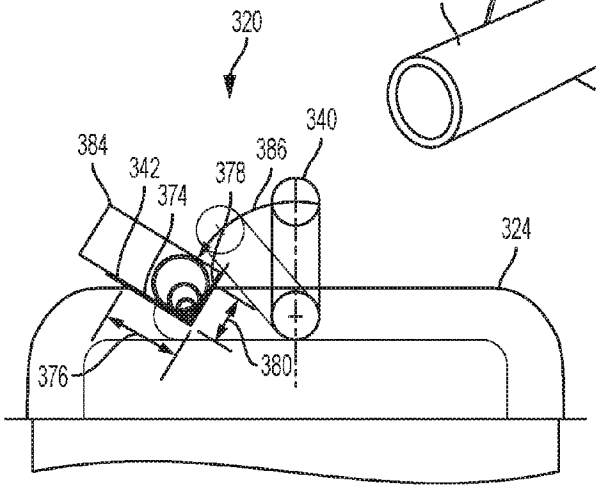
FIG. 28 is a side view of the device of FIG. 27, illustrating support of a work piece.

FIGS. 27-28 illustrate a tool storage device 320, such as a generally rigid tool box, including any one or more of the features of the tool boxes 20, 120, 220, etc., discussed above, and, likewise, the tool boxes 20, 120, 220, etc. can include features of the tool box 320 discussed below.

The tool box 320 includes a lid 324 having a handle 340 pivotally coupled to the lid 324, a groove 342 adjacent the handle 340 and a ruler 344 adjacent and outside the groove 342. The illustrated groove 342 is somewhat V-shaped but is asymmetric. Alternatively stated, the groove 342 has a first wall 374 having a first length 376 and second wall 378 having a different second length 380 (e.g., less the length 376 of the first wall 374). The walls 374, 378 are substantially perpendicular. The user can use the groove 342 to support a work piece, such as a conduit 382, a pipe, a wood stud 384, etc., and the user can pivot the handle 340 in the direction of arrow 386 to hold the work piece in the groove 342 and inhibit the work piece from moving (e.g., rotating, sliding) in the groove 342. The asymmetric shape of the groove 342 (discussed above) both holds the work piece in a more desirable position for cutting and inhibits the work piece from rotating in the groove 342 during cutting. The user can use the ruler 344 to measure the work piece and then cut the work piece to any desired length.

Figure 29:
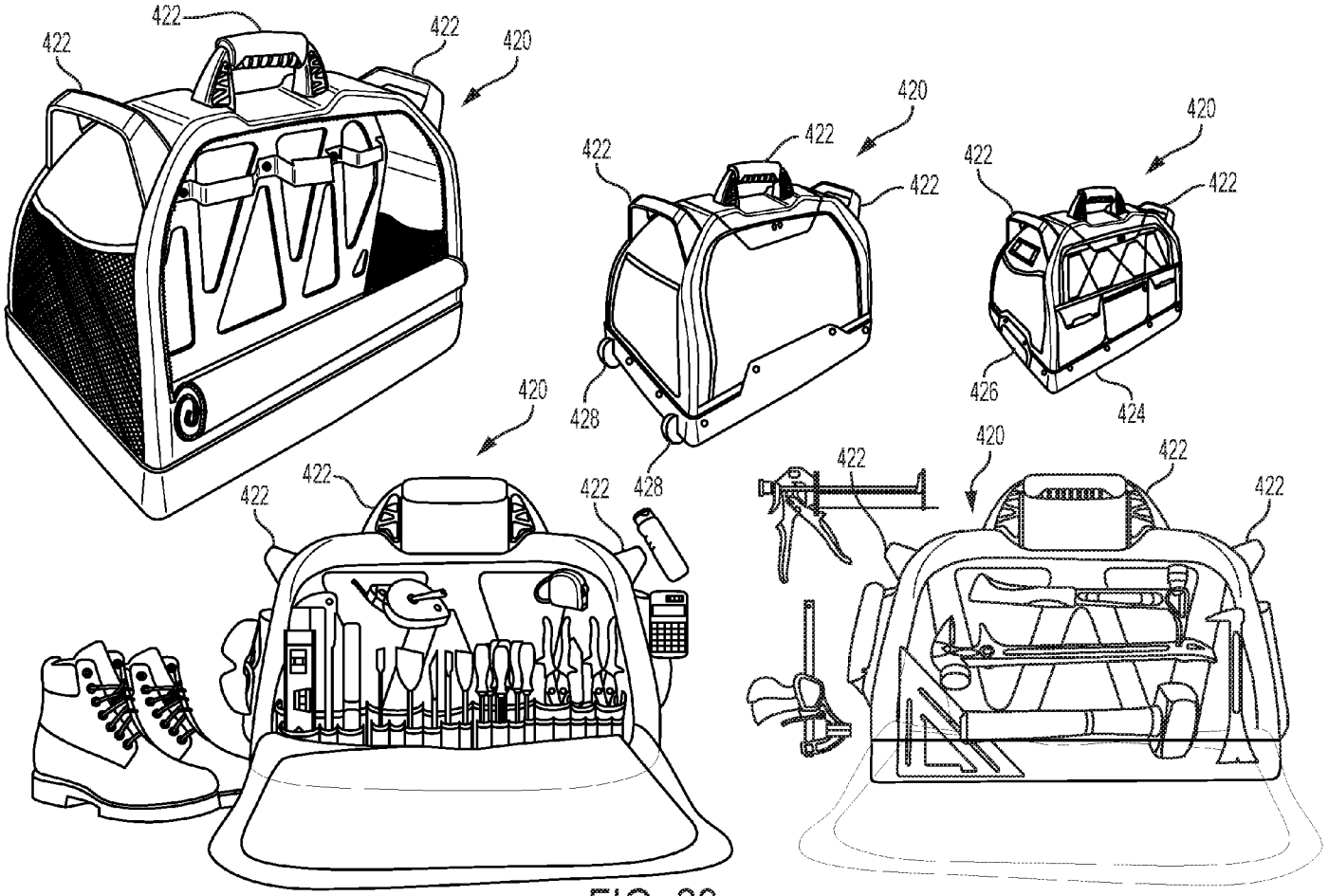
FIG. 29 illustrates a tool storage device according to another independent embodiment.

FIG. 29 illustrates a tool storage device 420, such as a generally soft-sided tool bag. The bag 420 includes handles 422 to carry or hang the bag 420. Also, the bag 420 includes rigid bottom 424. A handle 426 can telescope out from the bottom 424 of the bag 420 to allow the user to roll the bag on wheels 428.

Figure 30:
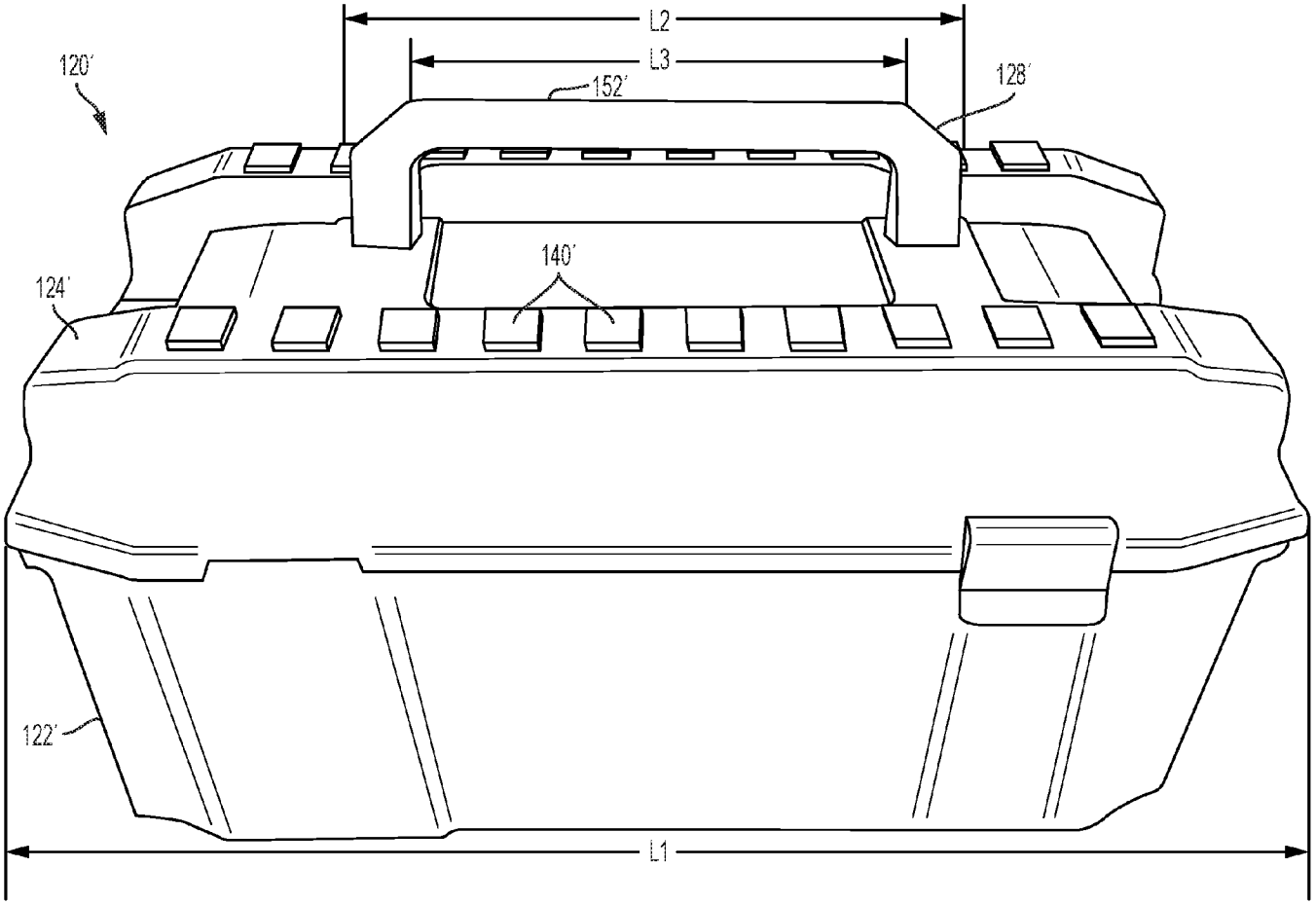
FIG. 30 is a front perspective view of a tool storage device according to another independent embodiment, illustrated in a closed position.
Figure 31:
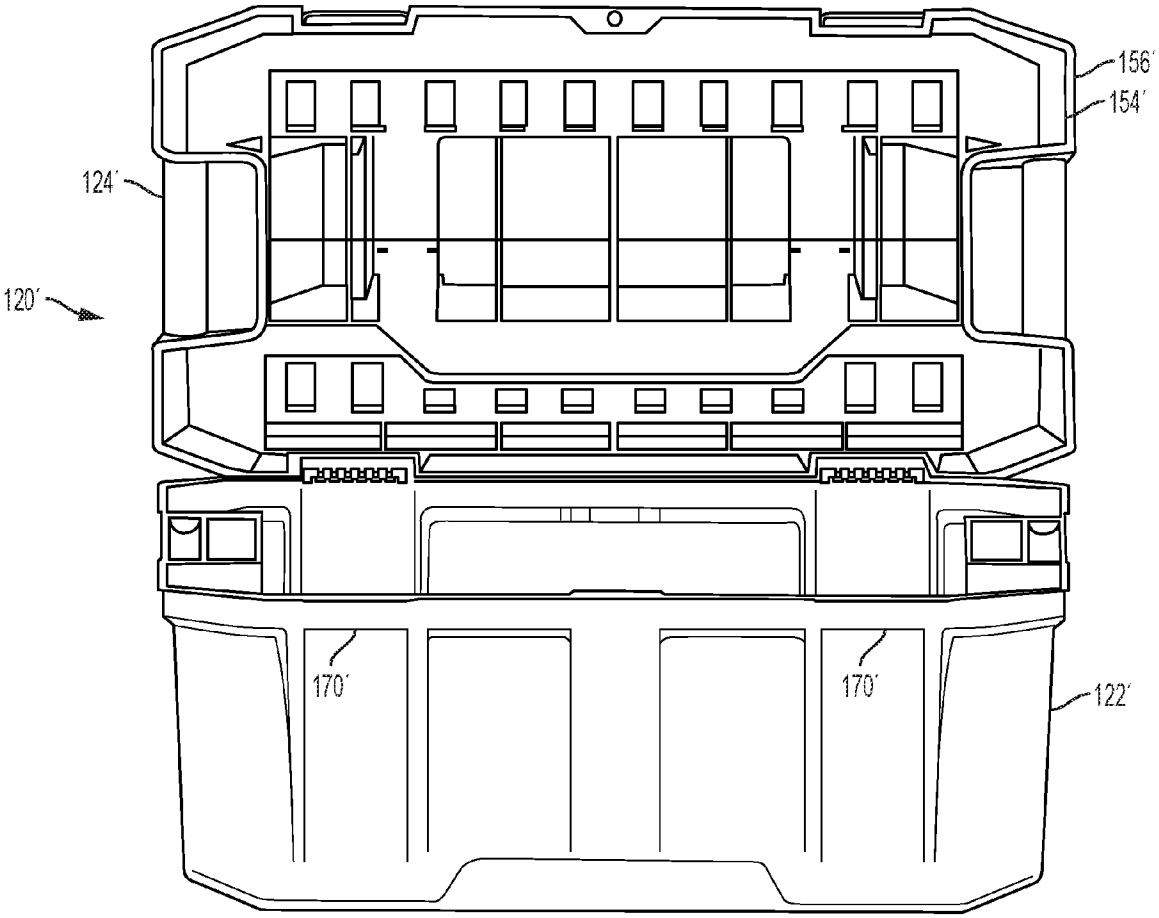
FIG. 31 is a front perspective view of the device of FIG. 30, illustrated in an open position.

FIGS. 30-31 illustrate a tool storage device 120', such as a generally rigid tool box, including a container 122' and a pivotable lid 124'. The lid 124' includes projections 140', and the container 122' can include complementary recesses (not shown) spaced and sized to receive the projections 140' so that multiple devices 120' can be securely stacked on top of one another.

With reference to FIG. 30, the lid 124' further includes a handle 128' pivotally coupled to the lid 124'. In the illustrated embodiment, the tool storage device 120' defines an overall length L1 of about 26 inches, permitting, for example, a standard 24 inch level to be stored within the container 122'. The handle 128' defines an overall length L2 of about 12 inches and has a grip portion 152' with a length L3 of about 10 inches. The grip portion 152' is long enough to permit a two-handed grip on the handle 128'. In addition, the relatively long grip portion 152' allows a user to select a gripping location on the handle 128' that provides optimum possible balance, particularly if the container 122' is loaded unevenly. A ratio of the length L2 of the handle to the length L1 of the tool storage device 120' is about 0.55 to about 0.35 (about 0.46 in the illustrated construction). A ratio of the grip portion length L3 of the handle 128' to the length L1 of the tool storage device 120' is about 0.50 to about 0.30 (about 0.39 in the illustrated construction).

Referring to FIG. 31, an elastomeric seal 154' extends along the perimeter of the lid 124'. When the lid 124' is closed, the seal 154' inhibits the ingress of water, contaminants into the container 122'. In the illustrated embodiment, the seal 154' is press-fit within a groove 156' of the lid 124' but may be affixed to the lid 124' by adhesive or by any other suitable means or affixed to the perimeter of the container 122'.

Figure 32:
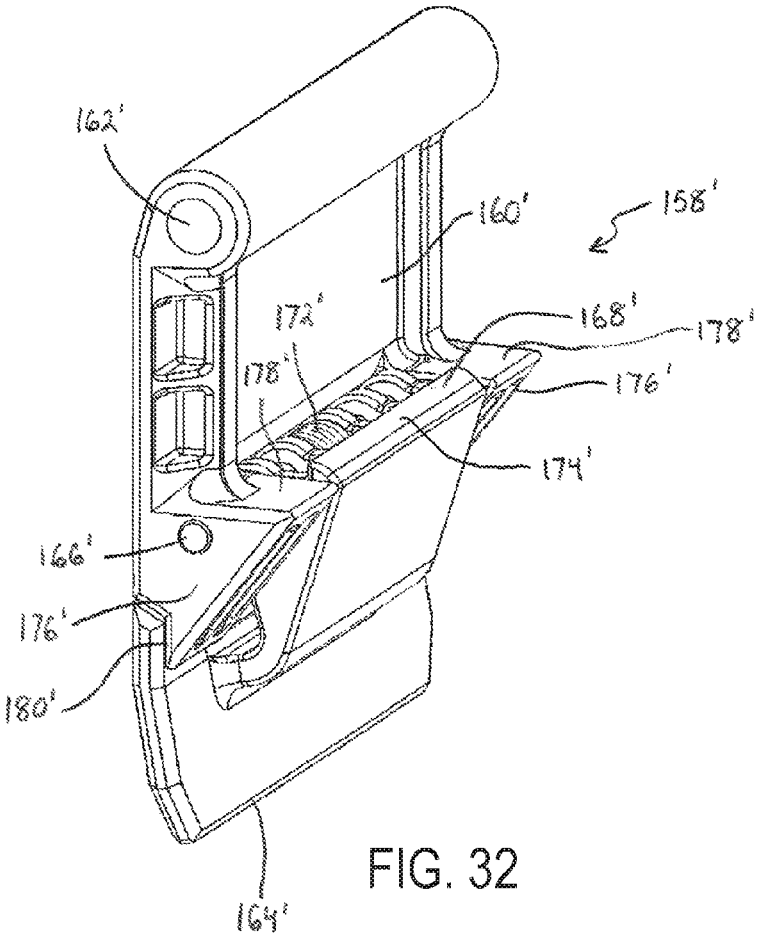
FIG. 32 is a perspective view of a latch according to one independent embodiment and usable with the tool storage device of FIG. 30.
Figure 33:
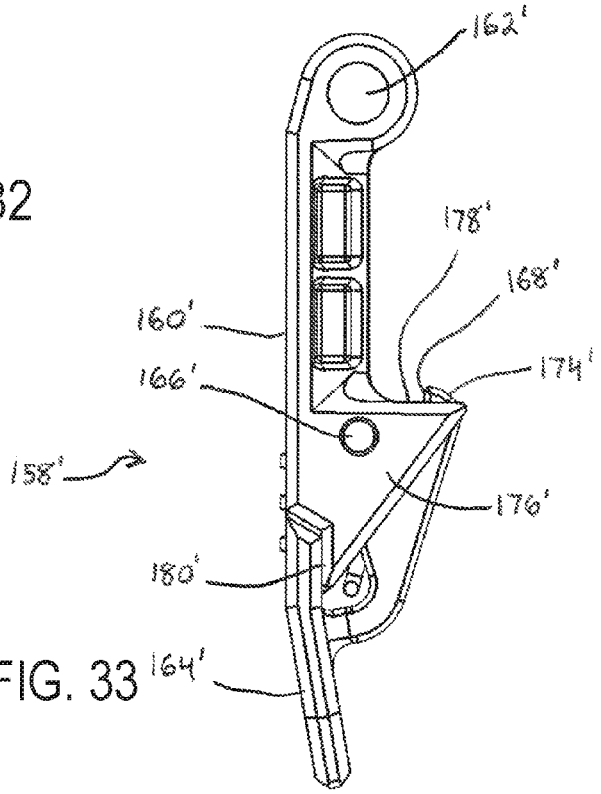
FIG. 33 is a side view of the latch of FIG. 32.

FIGS. 32-33 illustrate a latch 158' usable with the tool storage device 120'. The latch 158' selectively secures the lid 124' in a closed position. The latch 158' may be used individually, or may be one of a plurality latches 158'. The latch 158' includes a latch body 160' and a main hinge pin 162' that pivotally couples the latch body 160' to the lid 124' (FIG. 32). The latch 158' further includes a pull tab 164' pivotally coupled to the latch body 160' by a second hinge pin 166'. A hook 168' is disposed on the underside of the pull tab 164' and is engageable with a lip 170' on the container 122' (FIG. 31).

To disengage the latch 158' (e.g., to open the lid 124'), a user grasps the pull tab 164' and pivots the pull tab 164' relative to the latch body 160' against the biasing force a spring 172' (FIG. 32). This movement disengages the hook 168' from the lip 170', allowing the latch body 160' to pivot about the main hinge pin 162' and allowing the lid 124' to open. To engage the latch 158' (e.g., to close the lid 124'), the user presses the latch body 160' towards the lip 170'. The hook 168' includes a cam surface 174' that bears against the lip 170', pivoting the pull tab 164' away from the lip 170'. Once the cam surface 174' clears the lip 170', the biasing force of the spring 172' engages the hook 168' with the lip 170'.

With reference to FIG. 32, the latch 158' further includes a pair of generally triangular projections 176' through which the second hinge pin 166' passes. Each of the projections 166' includes a first side 178' engageable with the lip 170' to aid in securing the lid 124' in the closed position. Each of the projections 166' also includes a second side 180' generally perpendicular to the first side that acts as a stop surface for the pull tab 164'.

Figure 34:
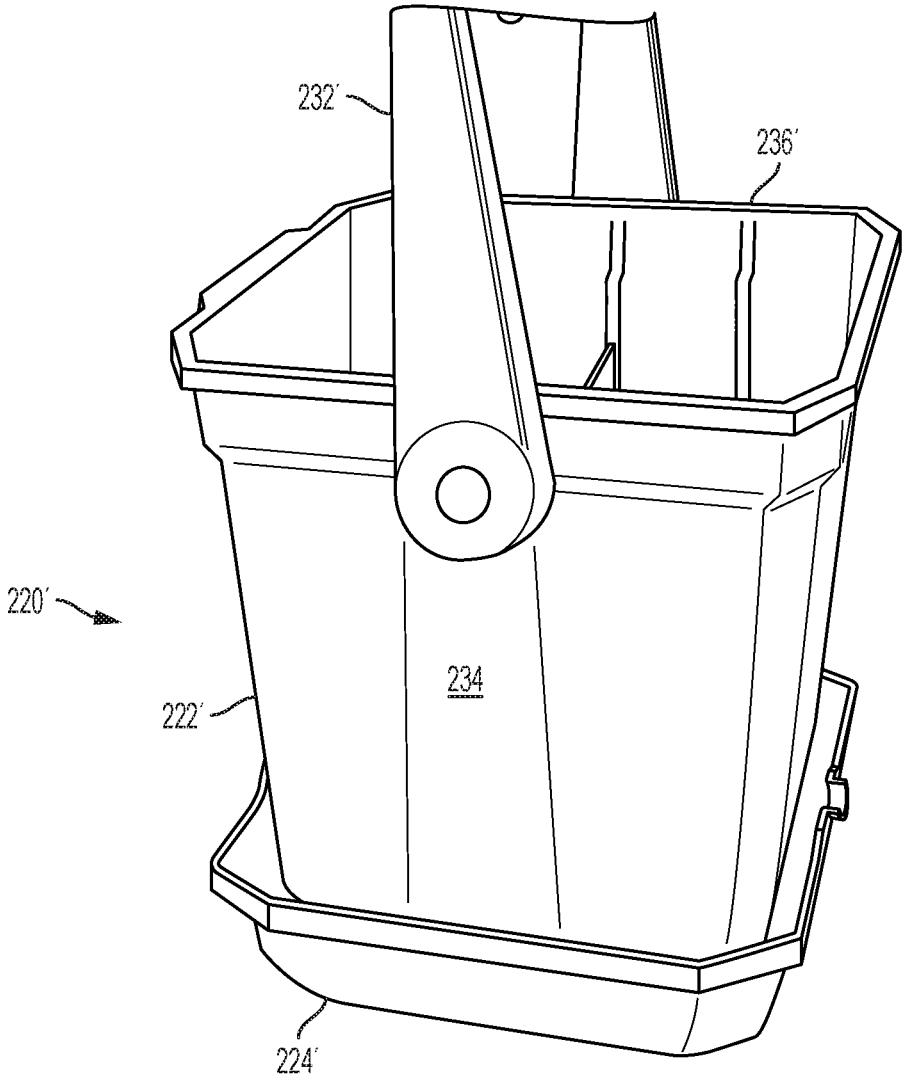
FIG. 34 is a perspective view of a tool storage device according to another independent embodiment.

FIG. 34 illustrates a tool storage device 220' including any one or more of the features of the tool storage device 120', etc., discussed above, and likewise the tool storage device 120', etc., can include features of the tool storage device 220' discussed below.

Figure 38:
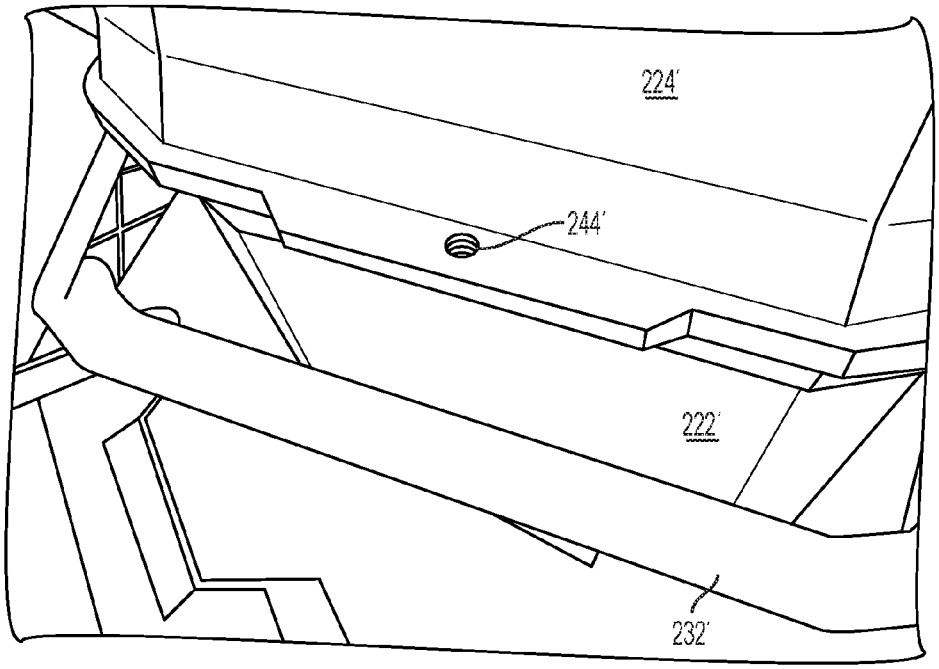
FIG. 38 is a perspective view of a portion of the device of FIG. 34, illustrated with the lid in a closed position.

The tool storage device 220' is a generally rigid tool box and includes a container 222' and a lid 224'. The device 220', the container 222' and the lid 224' each have a generally square cross-section. The illustrate container 222' generally tapers outwardly from the bottom toward the top. The lid 224' is attachable at the rim to the top of the container 222' (FIG. 38) in a closed position. The lid 224' is also attachable, for example, by a friction fit, at a position inwardly of the rim to the bottom of the container 222' (FIG. 34) in an open position to retain the lid 224' is retained with the container 222' (e.g., when moving the tool storage device 220'). In some embodiments, the tool storage device 220' is sufficiently strong so as to be usable as a support, stool, etc.

Figure 37:
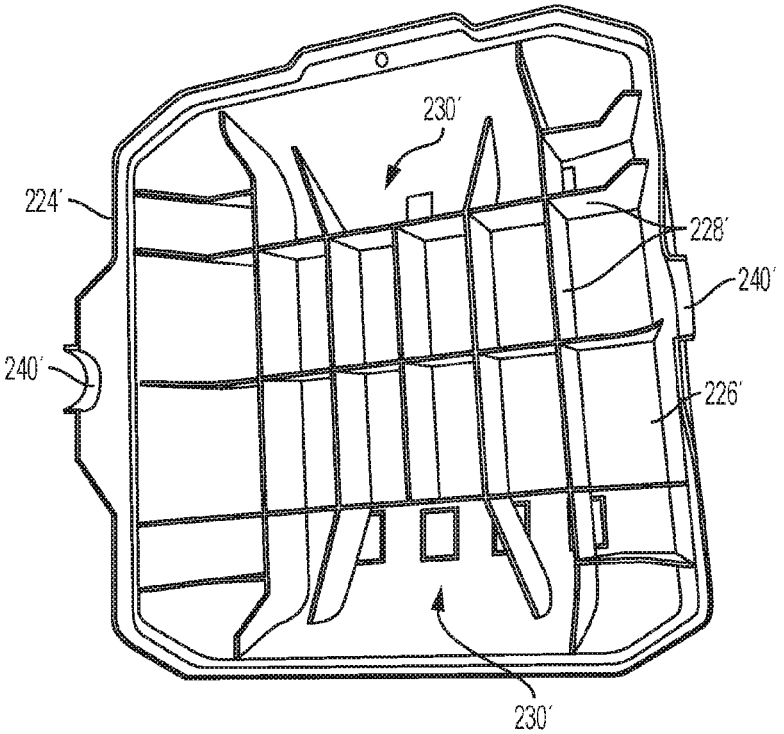
FIG. 37 is a perspective view of a lid of the device of FIG. 34.

With reference to FIG. 37, an underside 226' of the lid 224' includes ribs 228' that provide greater strength/rigidity to the lid 224', define compartments 230' with extra clearance for long items stored vertically within the container 222' or to organize small items (e.g., fasteners, bits, etc.) when the lid 224' is removed from the container 222'. The outer portions of the ribs 228' provide the location for attachment of the lid 224' to the bottom of the container 222'.

The tool storage device 220' further includes a handle 232' pivotally coupled to opposing sidewalls 234', 236' of the container 222'. The handle 232' includes receptacles 238' (FIG. 35) configured to receive arcuate projections 240' (FIG. 37) on the lid 224' when the lid 224' is in the closed position, to selectively lock the lid 224' in place. The handle 232' is pivotable between an unlocked position (FIG. 35), in which the arcuate projections 240' are insertable into the receptacles 238' through apertures 242', and a locked position (FIG. 38), in which the apertures 242' are misaligned with the arcuate projections 240' to prevent removal of the lid 224' from the container 222'. With continued reference to FIG. 38, the lid 224' and the container 222' collectively define an aperture 244' to receive an external lock (e.g., a padlock, not shown) to further secure the lid 224' to the container 222'. The external lock can interfere with movement of the handle 232' to retain the handle 232' in the locked position.

Figure 35:
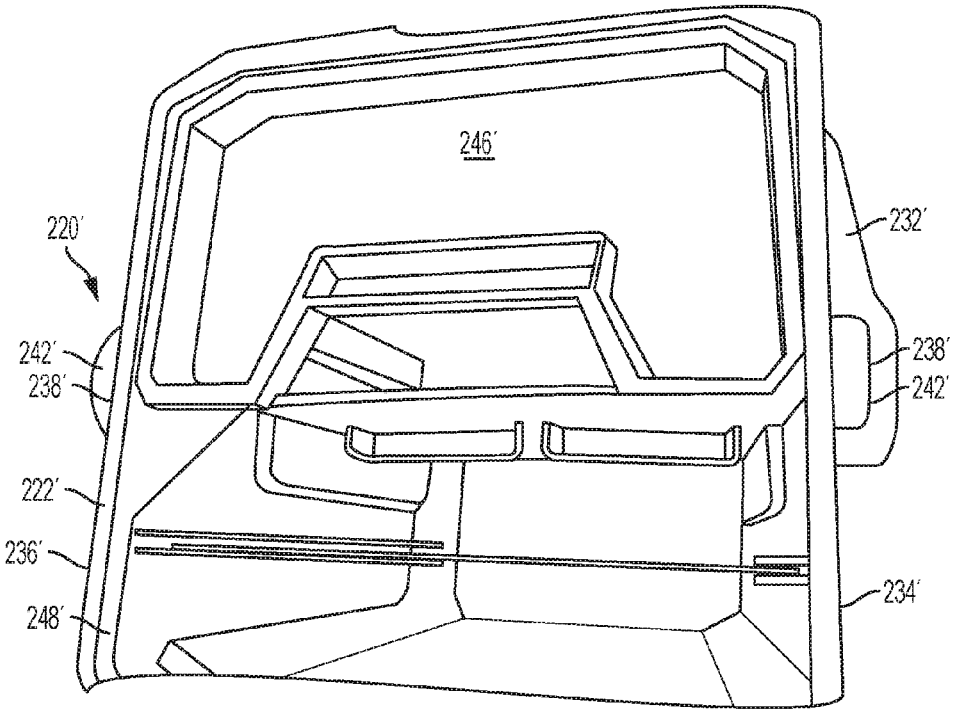
FIG. 35 is a perspective view of the device of FIG. 34, illustrated with a tray.
Figure 36:
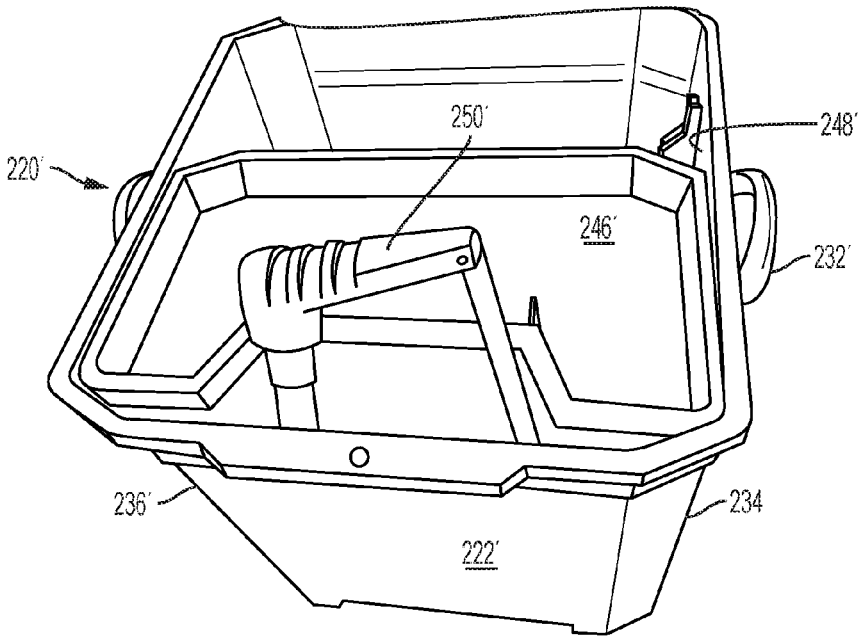
FIG. 36 is a perspective view of the device of FIG. 34, illustrated with the tray partially supporting a hack saw in the device.

Referring to FIGS. 35-36, the tool storage device 220' can include a tray 246' removably positioned in an upper portion 248' of the container 222'. The tray 246' may be particularly suitable for storing small items, such as a small tools, bits, fasteners, personal items (wallet, keys, cell phone), safety glasses, etc. The tray 246' can also act as a guide for positioning relatively long items (e.g., a hacksaw 250') in an upright position in the container 222' (FIG. 36).

Figure 39:
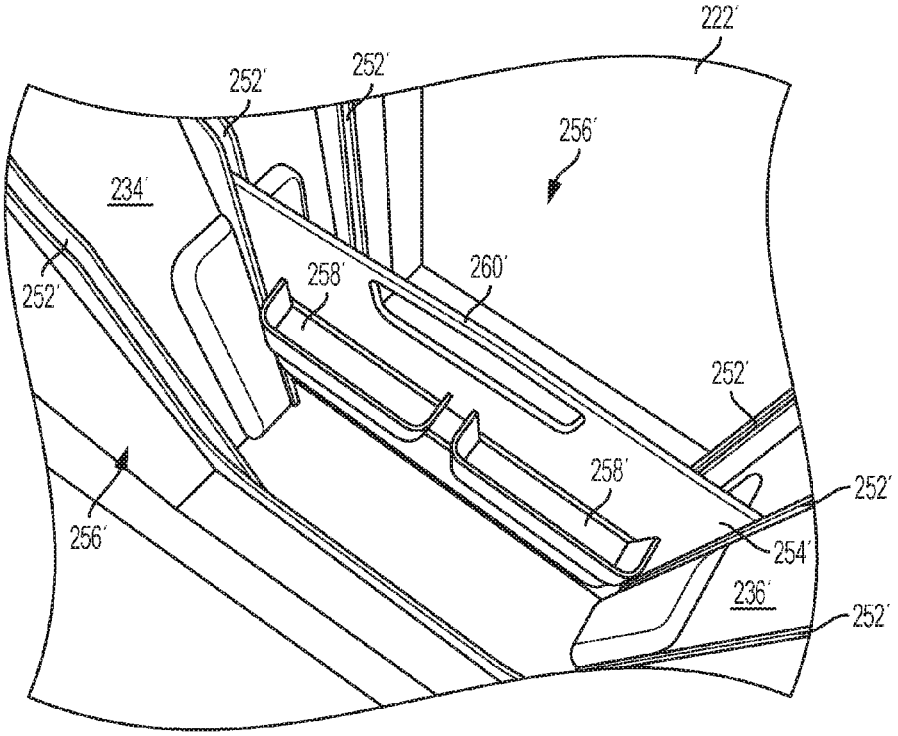
FIG. 39 is a perspective view of the device of FIG. 34, illustrated with a divider.
Figure 40:
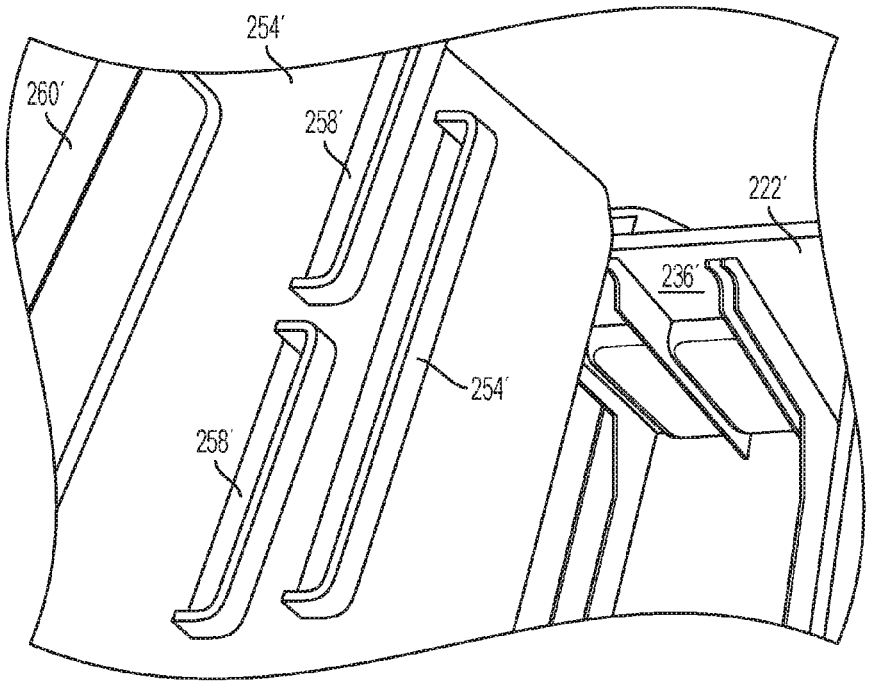
FIG. 40 is a perspective view of the divider shown in FIG. 39, illustrated removed from the device.

With reference to FIGS. 39-40, the sidewalls 234', 236' of the container 222' include slots 252' for receiving a divider 254'. The divider 254' can separate the container 222' into a plurality of compartments 256'. The divider 254' includes receptacles 258' for storing hand tools, such as screw drivers, wrenches, and the like. The divider 254' also includes a handle 260' to facilitate insertion/removal of the divider 254' from the container 222'. When removed, the divider 254' can be used separately from the tool storage device 220', hung on a wall, hook, etc.

It should be understood that, except when mutually exclusive or physically incompatible, features of any of the above-described tool storage devices may be used with others of the tool storage devices.

One or more independent features and independent advantages of the invention may be set forth in the following claims.

What is claimed is:

1. A tool box comprising:

a body defining a storage compartment;

a lid movable relative to the body between an open position to permit access to the storage compartment and a closed position to close the storage compartment, the lid having an outer surface, opposite walls and a length defined between the opposite walls, a groove being defined in the outer surface, the groove extending the length of the lid and opening through the opposite walls, the groove being configured to support an elongated work piece; and a handle having a first handle end and a second handle end pivotally coupled to the lid, the handle being pivotable about a pivot axis parallel to the length of the lid to engage a work piece supported in the groove, each handle end having opposite sides along the pivot axis and being pivotally supported by the lid on both opposite sides of each handle end;

wherein the groove has a proximal groove wall positioned closer to the pivot axis than an opposite distal groove wall, the proximal groove wall having a first portion positioned axially between the first handle end and one of the opposite walls of the lid, an intermediate portion positioned axially between the first handle end and the second handle end, and a second portion positioned axially between the second handle end and the other of the opposite walls of the lid, the first portion, the intermediate portion and the second portion extending to a position above the pivot axis.

2. The tool box of claim 1, wherein the groove has an asymmetric, generally V-shaped cross-section.

3. The tool box of claim 1, wherein the handle includes an elastomeric material engageable with the work piece.

4. The tool box of claim 1, wherein the distal groove wall has a width transverse to the length greater than a width of the proximal groove wall.

5. The tool box of claim 1, wherein the handle is pivotable between a raised position, in which the handle extends outwardly from the outer surface, and a storage position, in which the handle is at least partially received by the groove.

6. The tool box of claim 5, wherein, in the storage position, the handle is flush with or recessed into the outer surface.

7. The tool box of claim 1, wherein at least one of the body and the lid defines a side handle.

8. The tool box of claim 7, wherein the side handle is a first side handle, wherein at least one of the body and the lid defines a second side handle, and wherein the first side handle and the second side handle are on opposite sides of the tool box.

9. The tool box of claim 7, wherein the body defines the side handle, the body having a plurality of walls defining an outer periphery with a recessed area, the side handle extending across the recessed area, the recessed area providing clearance for gripping the side handle.

10. The tool box of claim 9, wherein the groove at least partially overlaps the recessed area.

11. The tool box of claim 9, wherein the storage compartment includes a pocket at least partially defined by the recessed area.

12. The tool box of claim 11, wherein an interior partition cooperates with at least one of the plurality of walls to define the pocket.

13. The tool box of claim 12, wherein the pocket is a corner pocket, and wherein three of the plurality of walls and the partition cooperate to define the corner pocket.

14. The tool box of claim 7, wherein the body defines a first portion of the side handle, and wherein the lid defines a second portion of the side handle.

15. The tool box of claim 1, wherein the first handle end is spaced from the one of the opposite walls of the lid and the second handle end is spaced from the other of the opposite walls of the lid.

16. A tool box comprising:

a body defining a storage compartment;

a lid movable relative to the body between an open position to permit access to the storage compartment and a closed position to close the storage compartment, the lid having an outer surface, opposite walls and a length defined between the opposite walls, a groove being defined in the outer surface, the groove extending the length of the lid and opening through the walls, the groove being configured to support an elongated work piece; and a handle pivotally coupled to the lid and extending along an axis parallel to the length of the lid, the handle being pivotable about a pivot axis to engage a work piece supported in the groove, the handle being pivotable between a raised position, in which the handle extends outwardly from the outer surface, and a storage position, in which the handle is at least partially received by the groove;

wherein the groove has a generally V-shaped cross-section defined by a proximal groove wall positioned closer to the pivot axis than an opposite distal groove wall, the distal groove wall being planar and extending to the outer surface, and wherein, when the handle is in the storage position, the handle extends from the pivot axis to a position beyond the distal groove wall and into a handle receiving recess defined by the outer surface of the lid.

17. The tool box of claim 16, wherein the body defines, on opposite sides of the tool box, at least a portion of a first side handle and at least a portion of a second side handle.

18. The tool box of claim 17, wherein the body has a plurality of walls defining an outer periphery with, on opposite sides of the tool box, a first recessed area and a second recessed area, the first side handle extending across the first recessed area, the second side handle extending across the second recessed area, each recessed area providing clearance for gripping an associated side handle.

19. The tool box of claim 16, wherein the storage compartment includes a first corner pocket at least partially defined by the first recessed area and a second corner pocket at least partially defined by the second recessed area.

20. The tool box of claim 16, wherein the outer surface defines a recess receiving the handle in the storage position, the recess having a recess wall extending parallel to the pivot axis and to the outer surface.

21. The tool box of claim 20, wherein the lid has an inner surface opposite the outer surface and includes a rib extending from the inner surface along the length of the lid and parallel to the groove, the rib being positioned farther from the pivot axis than the groove and the recess and between the groove and one of the opposite longitudinal walls, the rib having a uniform height defined between an end of the rib and the inner surface of the lid.

22. A tool box comprising:

a body defining a storage compartment, the body having an outer periphery defining a recessed area;

a lid movable relative to the body between an open position to permit access to the storage compartment and a closed position to close the storage compartment, the lid having an outer surface, an opposite inner surface, opposite side walls defining a length and opposite longitudinal walls extending along the length, a groove being defined in the outer surface, the groove extending the length of the lid and opening through the opposite side walls, the groove being configured to support an elongated work piece, the groove at least partially overlapping the recessed area; and a handle pivotally coupled to the lid and extending along an axis parallel to the length of the lid, the handle being pivotable about a pivot axis to engage a work piece supported in the groove;

wherein the lid includes a rib extending from the inner surface along the length of the lid and parallel to the groove, the rib being positioned between the groove and one of the opposite longitudinal walls, the rib being positioned farther from the pivot axis than the groove, the rib having a uniform height defined between an end of the rib and the inner surface of the lid.

23. The tool box of claim 22, wherein the body defines on opposite sides of the tool box at least a portion of a first side handle and at least a portion of a second side handle, wherein the outer periphery defines on opposite sides of the tool box a first recessed area and a second recessed area, the first side handle extending across the first recessed area, the second side handle extending across the second recessed area, each recessed area providing clearance for gripping an associated side handle, and wherein the storage compartment includes a first corner pocket at least partially defined by the first recessed area and a second corner pocket at least partially defined by the second recessed area.

24. The tool box of claim 22, wherein the handle is pivotable between a raised position, in which the handle extends outwardly from the outer surface, and a storage position, in which the handle is at least partially received by the groove.

25. The tool box of claim 22, wherein the groove has a proximal groove wall positioned closer to the pivot axis than an opposite distal groove wall, the distal groove wall being farther from the pivot axis than the proximal groove wall, the distal groove wall being planar and extending to the outer surface, and wherein the handle is pivotable between a raised position, in which the handle extends outwardly from the outer surface, and a storage position, in which the handle is at least partially received by the groove, and wherein, when the handle is in the storage position, the handle extends from the pivot axis beyond the distal groove wall.

* * * * *